US009587407B2

(12) United States Patent
Newman

(10) Patent No.: US 9,587,407 B2
(45) Date of Patent: Mar. 7, 2017

(54) ENVELOPE SYSTEM FOR SOLAR, STRUCTURAL INSULATED PANEL, MODULAR, PREFABRICATED, EMERGENCY AND OTHER STRUCTURES

(71) Applicant: Howard Hancock Newman, Newport, RI (US)

(72) Inventor: Howard Hancock Newman, Newport, RI (US)

( * ) Notice: Subject to any disclaimer, the term of this patent is extended or adjusted under 35 U.S.C. 154(b) by 13 days.

(21) Appl. No.: 14/686,983

(22) Filed: Apr. 15, 2015

(65) Prior Publication Data

US 2015/0308124 A1 Oct. 29, 2015

Related U.S. Application Data

(60) Provisional application No. 61/979,596, filed on Apr. 15, 2014.

(51) Int. Cl.

| | |
|---|---|
| ***E04B 1/00*** | (2006.01) |
| ***E04F 13/08*** | (2006.01) |
| ***E04F 15/16*** | (2006.01) |
| ***E04F 15/02*** | (2006.01) |
| ***E04F 19/06*** | (2006.01) |
| ***E04F 21/18*** | (2006.01) |

(52) U.S. Cl.

CPC ..... *E04F 13/0862* (2013.01); *E04F 13/0835* (2013.01); *E04F 13/0846* (2013.01); *E04F 13/0894* (2013.01); *E04F 15/02038* (2013.01); *E04F 15/166* (2013.01); *E04F 19/064* (2013.01); *E04F 21/1883* (2013.01)

(58) Field of Classification Search

CPC ..... E04F 13/0894; E04F 13/0846; E04F 13/0835; E04F 19/064; E04F 15/02038; E04F 13/0862; E04F 21/1883; E04F 15/166

See application file for complete search history.

(56) References Cited

U.S. PATENT DOCUMENTS

| | | | | | |
|---|---|---|---|---|---|
| 476,354 | A * | 6/1892 | Ams | E04F 13/0862 | 52/388 |
| 762,428 | A * | 6/1904 | Munro | E04F 15/02 | 404/45 |
| 2,887,867 | A * | 5/1959 | Burchenal | B32B 37/00 | 156/299 |
| 3,077,059 | A * | 2/1963 | Stout | E04F 13/0862 | 428/906 |
| 3,611,655 | A * | 10/1971 | Loebner | E04F 15/105 | 160/133 |
| 3,848,615 | A | 11/1974 | Warner | | |
| 3,867,051 | A | 2/1975 | Bjorhaag | | |
| 4,277,201 | A * | 7/1981 | Abell | E01C 19/522 | 404/35 |

(Continued)

FOREIGN PATENT DOCUMENTS

| | | | | |
|---|---|---|---|---|
| DE | 3217936 A1 * | 11/1983 | ..... | E04F 13/0862 |
| ES | WO 0071823 A1 * | 11/2000 | ..... | E04B 1/3205 |

(Continued)

*Primary Examiner* — Adriana Figueroa

(57) ABSTRACT

A method for assembling tiles onto a substrate relating to permanent and temporary envelopes for building construction, roads, emergency constructions, and civilian, military, air, naval and space vehicles, based on the integration of a foldable flexible backer member with tessellations, resulting in a stackable, portable, installable assembly.

25 Claims, 26 Drawing Sheets

(56) References Cited

U.S. PATENT DOCUMENTS

| | | | | |
|---|---|---|---|---|
| 4,387,533 | A | 6/1983 | Green | |
| 4,879,818 | A | 11/1989 | Beaulieu | |
| 5,325,652 | A * | 7/1994 | Feder | B32B 9/04 52/249 |
| 7,752,820 | B2 * | 7/2010 | Deschamps | E01C 9/08 52/108 |
| 8,256,178 | B2 * | 9/2012 | Sarrablo Moreno | B28B 19/0053 52/388 |
| 8,534,003 | B2 * | 9/2013 | Curry, III | E04B 1/3205 52/592.1 |
| 2008/0245019 | A1 | 10/2008 | Vilar Llop et al. | |
| 2009/0107071 | A1 * | 4/2009 | Starke | E04F 15/18 52/385 |
| 2010/0107531 | A1 * | 5/2010 | Hunsaker | E04F 13/147 52/314 |

FOREIGN PATENT DOCUMENTS

| | | | | |
|---|---|---|---|---|
| NL | 7610592 | A * | 3/1978 | E01C 9/02 |
| WO | WO 0233195 | A1 | 4/2002 | |

* cited by examiner

Prior art

Prior art

Prior art

Prior art

2101

2103
2102

FIG. 24A1
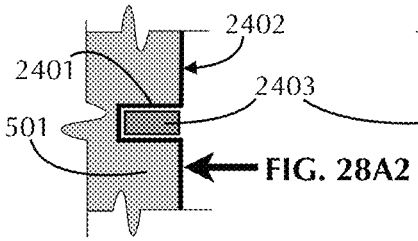
FIG. 24A2
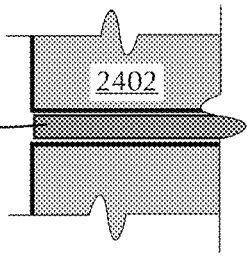
FIG. 24A3
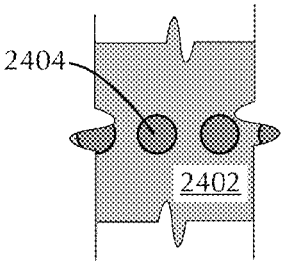
FIG. 24B1
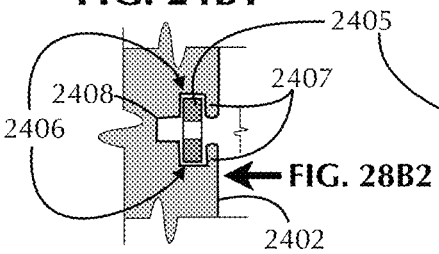
FIG. 24B2
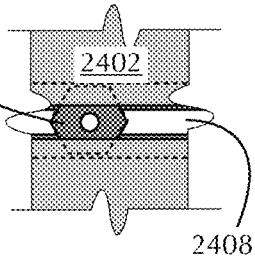
FIG. 24C1
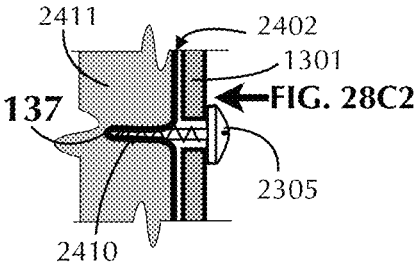
FIG. 24C2
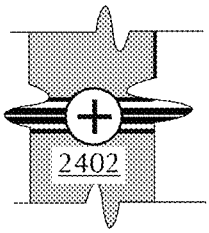
FIG. 24D1
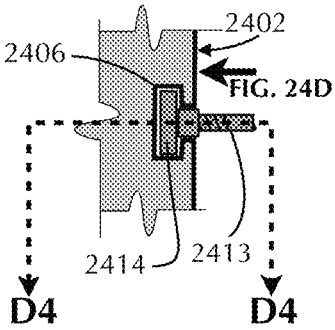
FIG. 24D2
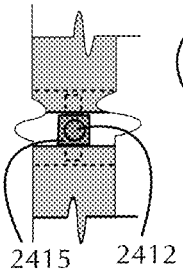
FIG. 24D3
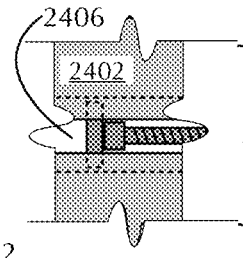
FIG. 24D4
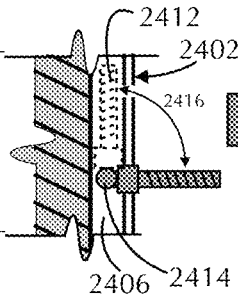
FIG. 24D5
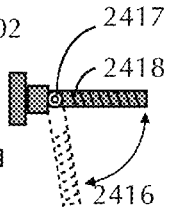

ENVELOPE SYSTEM FOR SOLAR, STRUCTURAL INSULATED PANEL, MODULAR, PREFABRICATED, EMERGENCY AND OTHER STRUCTURES

CROSS-REFERENCE TO RELATED APPLICATION

This application claims priority from Provisional Application Ser. No. 61/979,596 filed Apr. 15, 2014.

BACKGROUND OF THE INVENTION

Description of Prior Art

The use of multiple tile elements, or tessellations, for creating durable, protective surfaces is traditionally achieved by assembling multiple separate similar elements in a regular pattern by use of tools such as shown in FIG. 1 for installing clapboards. The environments on opposing sides of the resultant surfaces are often further isolated from one another by the use of membranes located between the tessellations and the substrates, said phrase referring to any supporting substrates for buildings, vehicles, earthen works such as roads and dams, tooling, casings and the like, of all scales.

In the construction of buildings, tessellations are: lapped boards and shingles made of wood, slate, asphalt, metals, fiber cement, vinyl, polymers, other usable materials and their composites. In the prior art, after constructing a building's underlying substrate, a layer of backing boards provides a strong, workable surface upon which a semipermeable membrane is fastened. Finally, individual tiles are lifted, positioned, and fastened one-by-one or in small groups with nails or screws that fasten the tiles to the substrate, the entire cladding process being labor intensive and time consuming.

This process has been improved by the manufacture of larger tiles that sometime appear to be multiple units, such as vinyl siding and roof shingles and structural insulated interlocking panels which combine the functions of backing board, barrier film and, in some iterations, exterior finish elements. The process is, however, essentially the same as installing individual elements, still requiring considerable time and labor.

Films have also been developed such as flexible protective polymeric skins now used to envelope buildings during construction and for boat storage. The specific qualities of these films—their flexibility, stretchability, durability and shrinkability—confer many advantages but are limited in their appearance and ability to isolate and protect the environments on their opposing sides.

The growing incidence of catastrophic events generated by climate change—flooding, tornadoes, earthquakes, fires and the like demonstrates the need for a more efficient cladding system for temporary, semipermanent and permanent substrates.

Road pavements, including the recent development of solar tiling for roadways, are installed manually, one-by-one. In recent decades, several innovations have mechanized this process, one example being Stone setting machine U.S. Pat. No. 3,867,051 A. See FIG. 4. The systems and machines presently used for these installations will also derive benefit from incorporating the present invention. See, for example: FIGS. 2 and 3.

Ceramic and wood tiling of the prior art comprising a flexible backer member specifically require cementing and grouting the tiles to a floor or wall. See FIGS. 2 and 3. The present invention teaches around and expands those specifics. See: The assembly on backing U.S. Pat. No. 2,887,867; U.S. Pat. No. 762,428 Tiling for floors &c.; Assembly system for floor and/or wall tiles U.S. Pat. No. 7,958,688 B2; A method for setting tile and a tile WO 2002033195 A1 and; Wooden tile flooring system US20090107071.

The prior art also includes Venetian blinds, Roman shades, louvers, jalousies, brise soleil, Holland blinds, pleated blinds, and roller shades, all of which are restricted to their specific use as window elements. The present invention expands on all these by integrating the flexible backer member and tile elements in novel ways.

The use of tessellations comprising flexible connectors is also common in the prior art, but in specific technologies such as garage doors FIG. 5. The present invention employs the elements of the system for other purposes and in other ways.

The unobviousness of the present invention stems from the fact that all the above mentioned mechanisms have been known for decades, and even millennia, for their specific uses without the present invention having been integrated with these mechanisms.

From the above observations of prior art it is clear that major improvements in the systems for covering surfaces can be effected by applying the innovation described herein.

BRIEF SUMMARY OF THE INVENTION

The present invention is an improved system for interior and exterior cladding of buildings, vehicles, roads and other constructions comprised of tessellations attached to a flexible backer member by connectors, whereby the resultant assembly of elements is potentially foldable, interconnectable, and dispensable onto any surface.

Elements of the assembly of the present invention are of any scale and/or shape from nanoscopic to massive. Embodiments of the assemblies can be comprised of any number of tessellations in any lateral dimensions or thicknesses.

Examples of industries which will benefit by the present invention are: building construction; energy harvesting and transmission; insulation; road paving including solar roadways; display and packaging; military, air, sea and space vehicles; furniture; tools; and toys.

DEFINITIONS IN THE PRESENT INVENTION

Assembly: A construct comprised of flexible backer member, tessellations and connectors as described herein.

Tessellation: A generic term for 'tile'. As used herein, tessellations or tiles are generally similar members intended to be secured in a predetermined pattern on a substrate. They may be substantially identical; for example, clapboards intended to be attached to a building, and hexagonal tiles intended to be affixed to a roadway, sidewalk or the like. Alternately, the tiles may be of any organized group of forms.

Flexible Backer Member: A membrane, film, sheet or series of contiguous, flexible interlinked elements, comprised of any suitable material of any lateral dimension or thickness. The backer member must be flexible enough to allow folding, to allow an assembly of tiles and backer member to be stacked, and strong enough to maintain the tiles in their desired orientation prior to being secured to the substrate. Examples are spunbond olefin material for building siding, one such product known commercially as "Tyvek."

Connector: These connect the elements of the assembly. Examples are glues, curable resins such as epoxies, two-sided adhesive tape, hook-and-loop connectors, mechanical fasteners such as staples, nails and screws, processes such as welding and soldering, Fastener: Elements securing the tiles to a substrate. Examples are screws, nails, staples, rivets, curable materials such as adhesives of various types and other mechanisms and processes according to the particular embodiment.

Substrate: The element to which the assembly of tiles, connector and backer is to be secured, examples being joists, studs, chassis, and road beds.

Back, or Inside of a tile, tessellation or assembly: The face of a tile or tessellation which is intended to be secured to the substrate.

Face, Front or Outside of a tile, tessellation or assembly: The face opposite the side of a tessellation or assembly which is secured to the substrate.

Stack: An assembly of tessellations connected by a flexible backer member in which the tessellations are arranged one on top of another like a stack of cards, that is, where the similar faces of the tessellations are facing in the same direction. This arrangement is distinct from an accordion or fan-fold arrangement wherein the similar faces, when in their folded position, face one another in an alternating fashion. As with a stack of cards, the tiles may be stacked entirely atop one another, be diagonally offset, or form another pattern.

A tool for the installation of clapboards.

Figure 2:
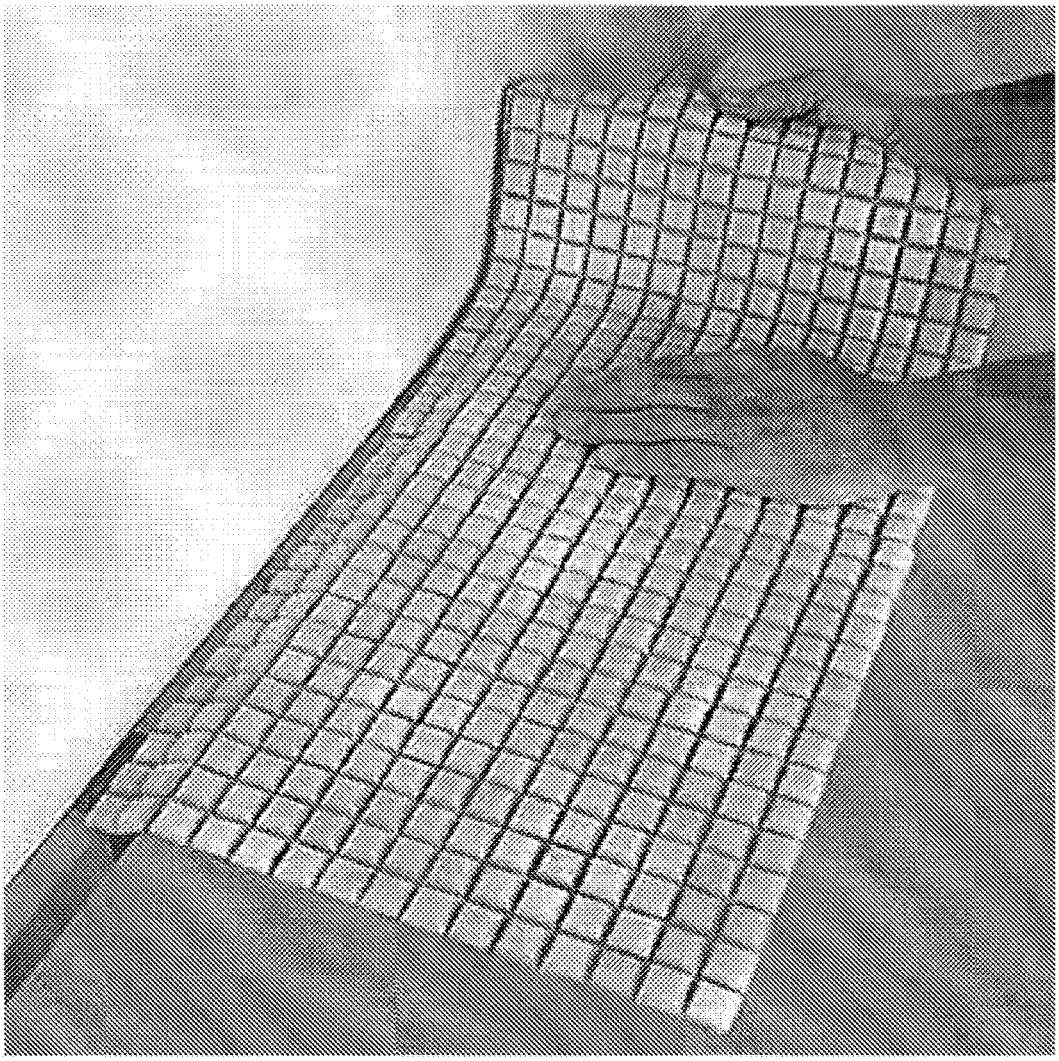

FIG. 2: PRIOR ART; Bathroom tile set (Image from http://www.thisoldhouse.com/toh/how-to/step/0,20336947_20727303,00.html).

An example of ceramic tiling bound with flexible mesh.

Figure 3:
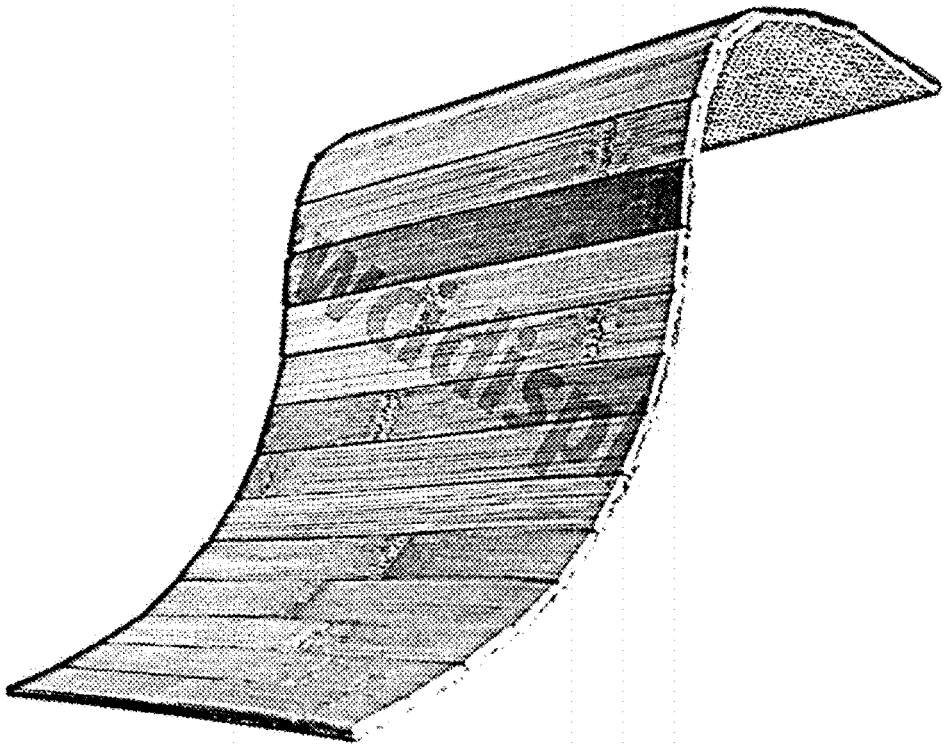

FIG. 3: PRIOR ART; Wooden flooring with a flexible mesh

Figure 4:
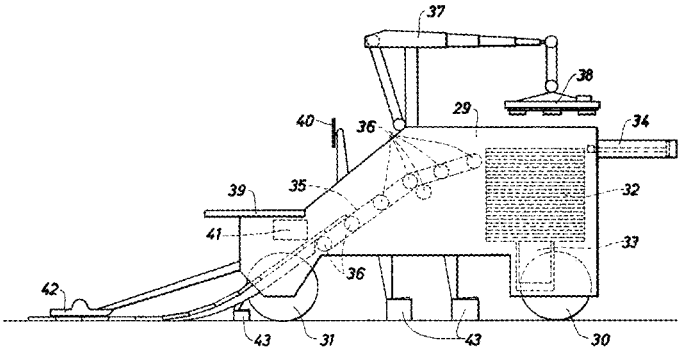

FIG. 4: PRIOR ART; Paving Machine

From: Stone setting machine U.S. Pat. No. 3,867,051 A.

FIG. 5: Model made of EVA foam tiles and spunbond olefin fiber

A series of views of a model demonstrating the invention's basic principles.

Figure 5A:
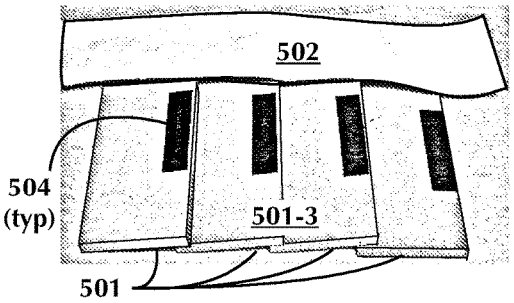
Figure 5B:
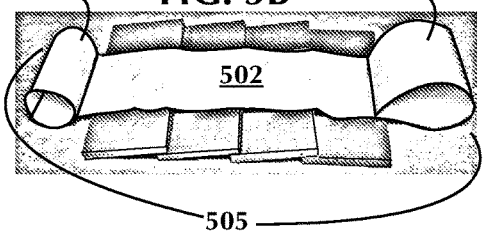
Figure 5C:
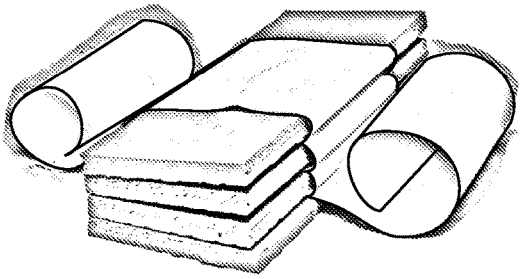

FIG. 5A through C show the steps of making an assembly of the present invention from its separate parts through to its folded state ready for packaging.

FIG. 5D through G show how the assembly is spread out from its folded state onto a surface.

Figure 5D:
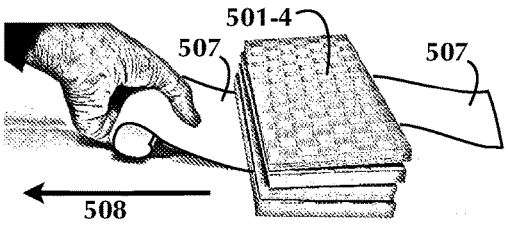
Figure 5E:
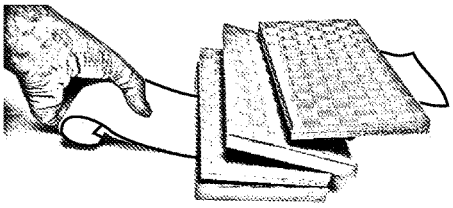
Figure 5F:
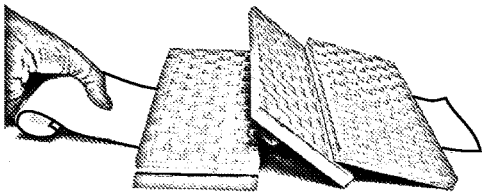
Figure 5G:
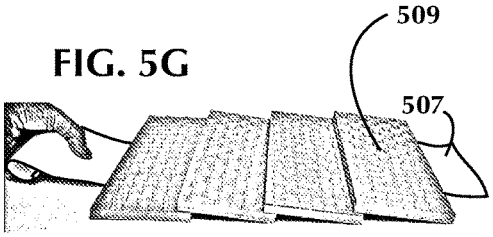
Figure 5H:
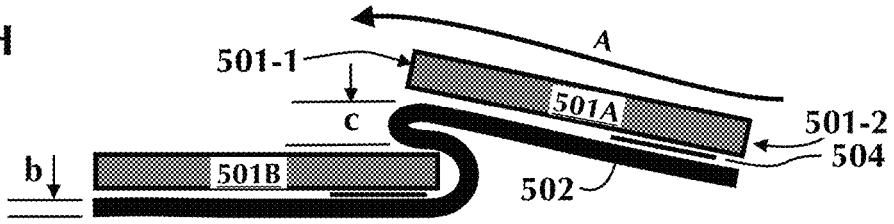

FIGS. 5H, I, J and K are side views of the assembly, with measurements.

Figure 5I:
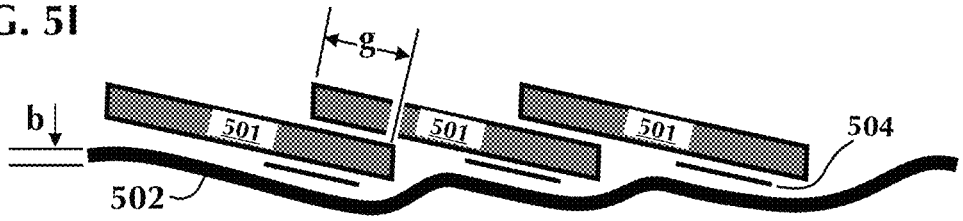
Figure 5J:
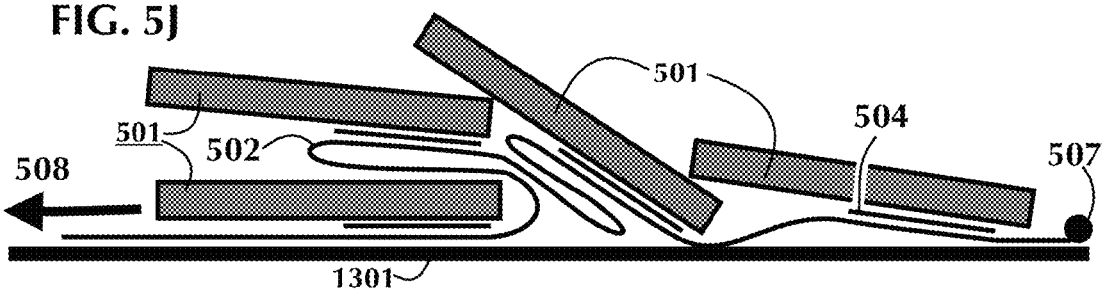
Figure 5K:
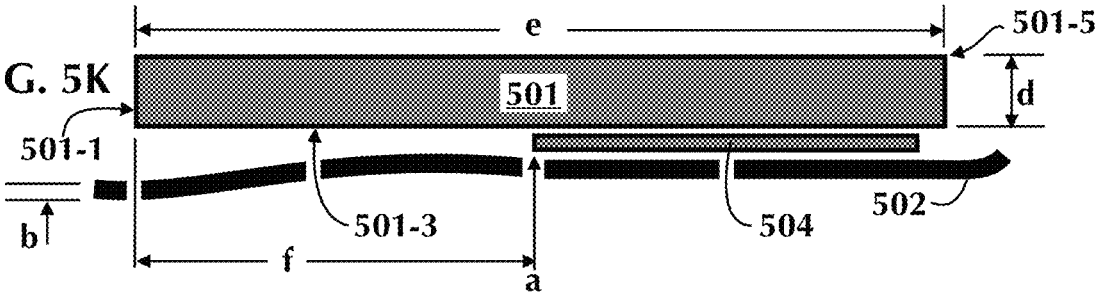
Figure 5L:
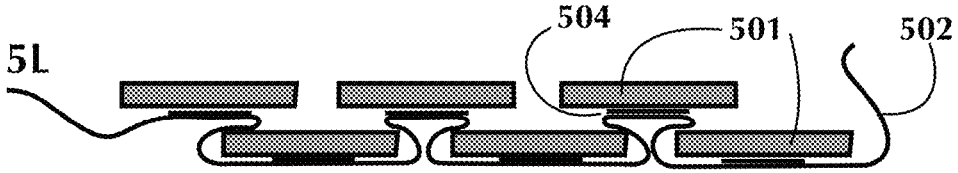

FIGS. 5L and M show one example of a multilevel assembly stack configuration with a closeup of one tessellation and the connector, along with measurements.

Figure 5M:
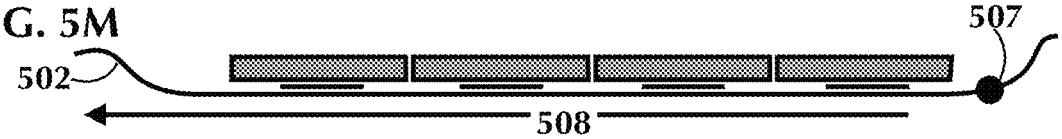
Figure 5N:
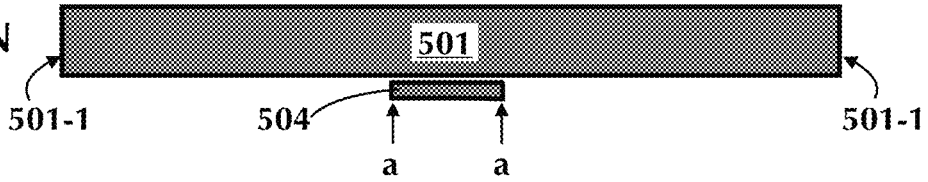

FIG. 5N shows a single tessellation of the assembly of FIGS. 5L and M.

Figure 5P:
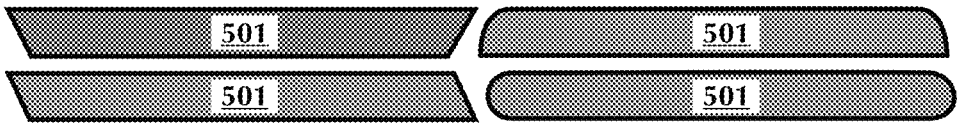

FIG. 5P shows various conceptual profiles of tessellation edge variations.

FIG. 5Q through V show plan and side views of layout boards for three different tessellation arrangements; overlapped; butted; and with spaces between the tessellations.

FIG. 6: Z-shaped tiles being arrayed

Figure 6A:
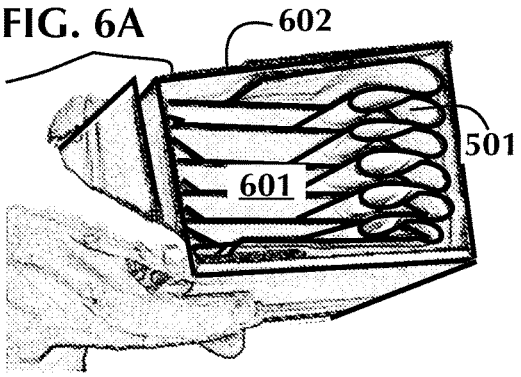

FIG. 6A shows a model built using the principles of the invention, constructed of Z-shaped metal tiles. The dispenser package has been cut away to reveal the arrangement of the stacked assembly within.

FIG. 6B through E show the assembly being connected and progressively arrayed across a substrate.

FIG. 7: Z-shaped tiles being retracted

FIG. 7A through G show the model of FIG. 6 being retracted into the dispenser package for optional future reuse.

Figure 8:
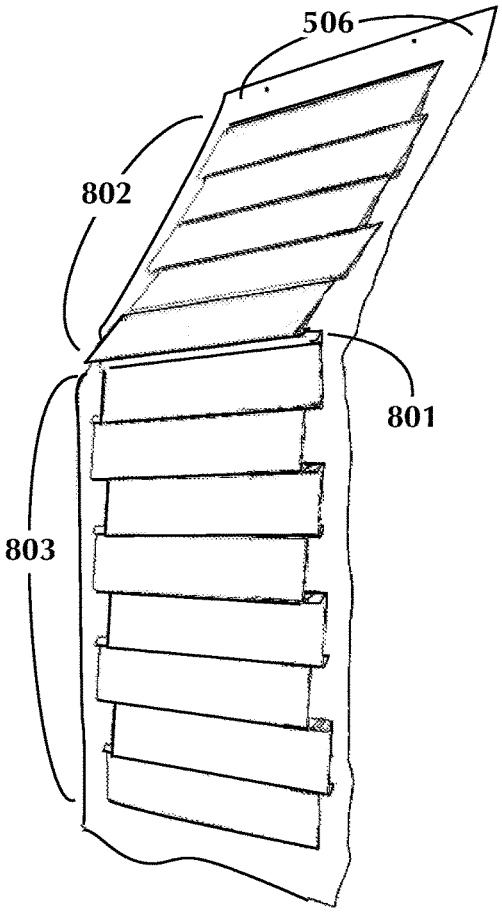

FIG. 8: Multi-planar assembly

An installation of a multi-planar assembly, simulating the present invention's use on the roof and wall of a building.

Figure 9:
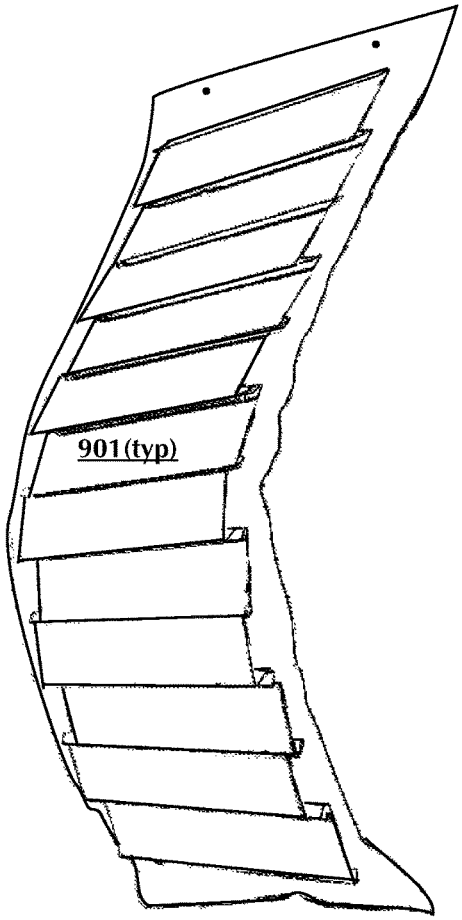

FIG. 9: Curved assembly

An installation of a curved assembly, an example of which is to be used on, for example, a boat hull.

FIG. 10: Z-shaped tile detail

Figure 10A:
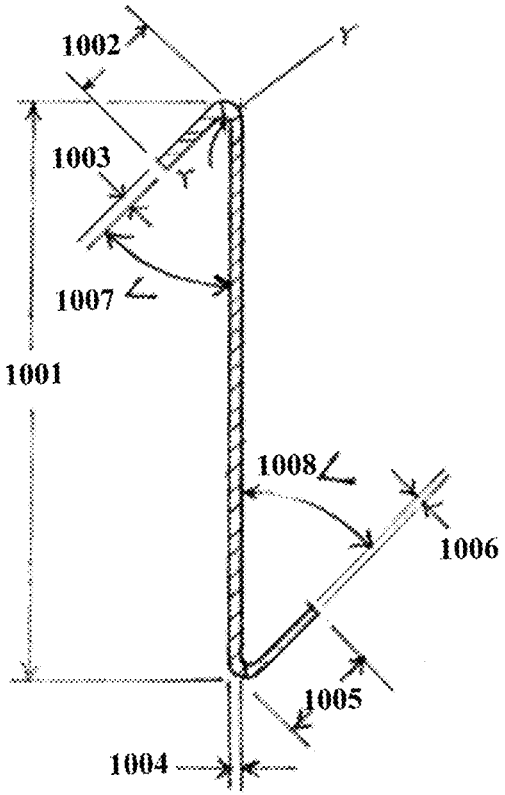

FIG. 10A shows a cross section of an interlocking Z-shaped tessellation.

Figure 10B:
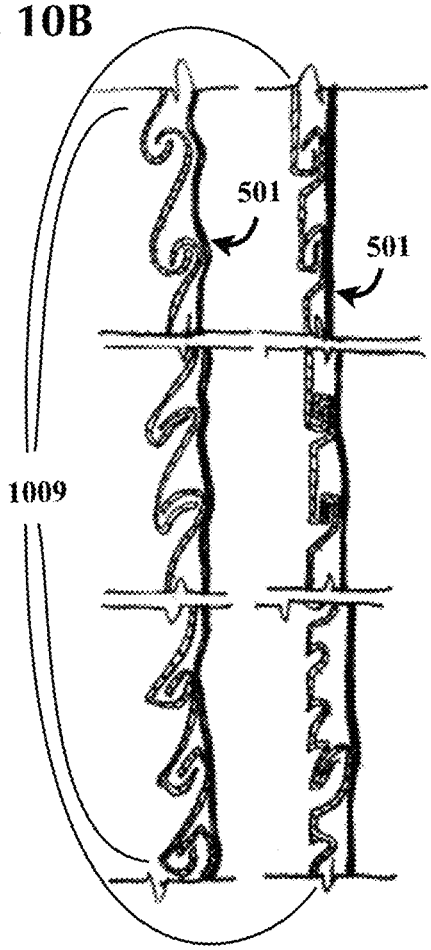

FIG. 10B shows a sampling of possible tessellation profiles, similar to the profiles of building clapboards, bound by flexible backer members.

FIG. 11: Wood clapboards

FIG. 11A through D are similar to FIG. 6, but with traditional wood clapboards.

Figure 11A:
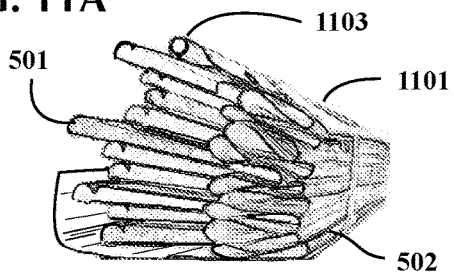
Figure 11B:
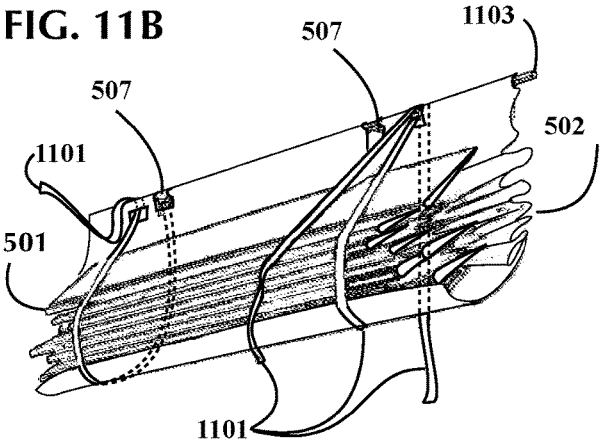
Figure 11C:
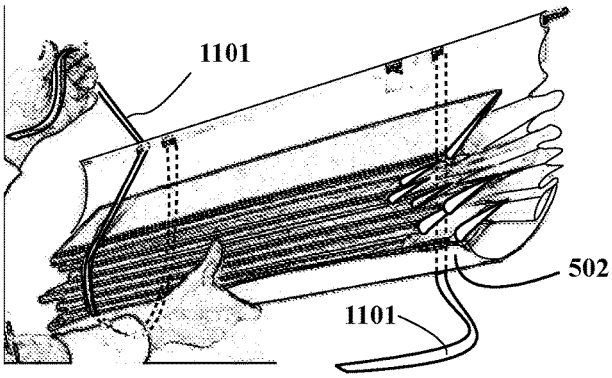
Figure 11D:
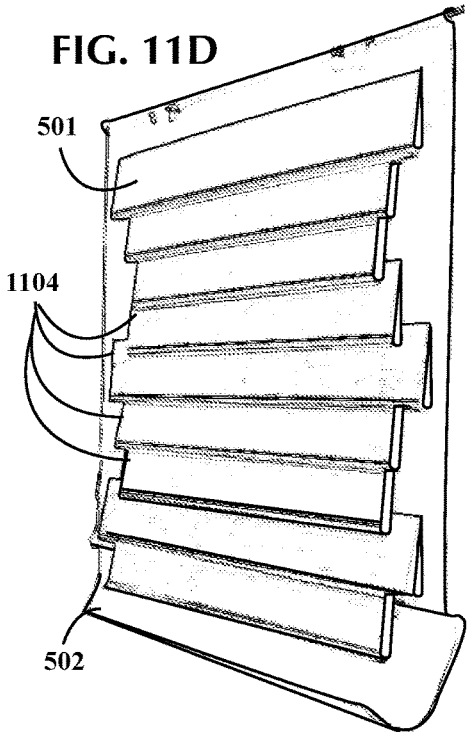
Figure 11E:
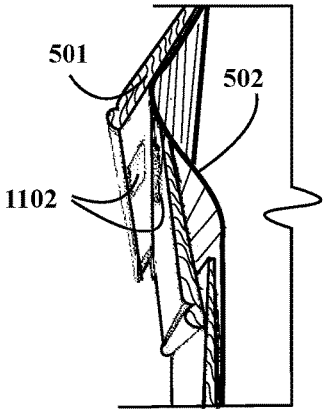

FIG. 11E shows connectors, in this model hook and loop type, for restraining the clapboards from damage due to wind shear.

FIG. 12: Ventilating tile assembly

One example of tiles which permit circulation of air and other fluids, showing one type of circulation system.

Figure 12A:
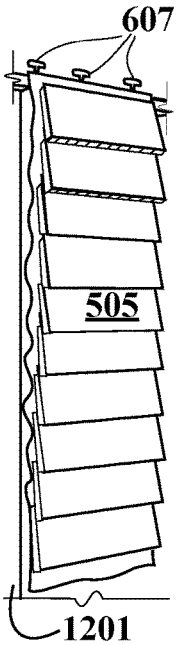

FIGS. 12A B and C show an arrayed model assembly with wrappable assembly-to-substrate connectors.

Figure 12B:
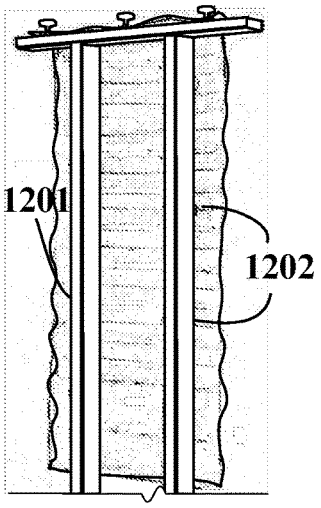
Figure 12C:
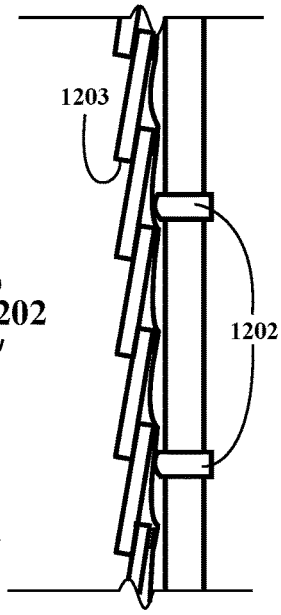
Figure 12D:
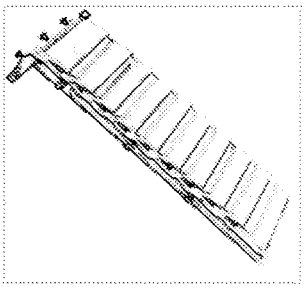

FIG. 12D shows an arrayed assembly in a position simulating a roof installation.

Figure 12E:
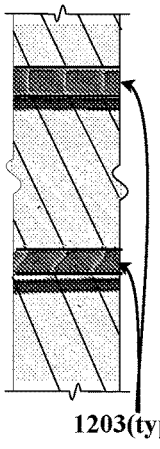
Figure 12F:
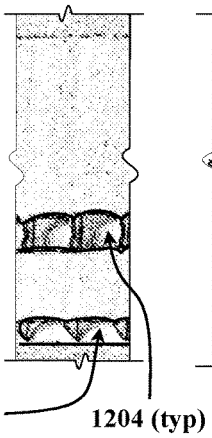
Figure 12G:
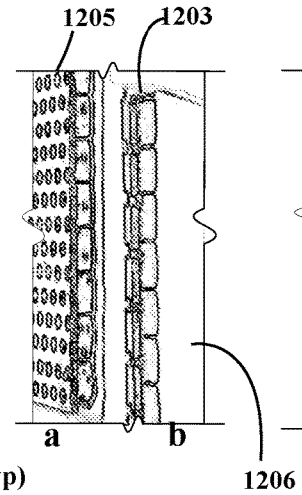

FIG. 12E through G show tessellations with edge ventilator ports.

Figure 12H:
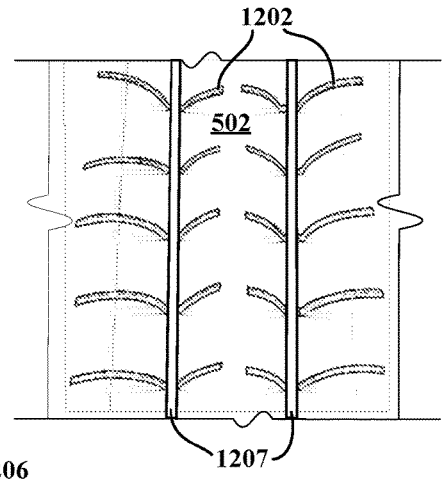

FIG. 12H shows the substrate side of a flexible backer member with assembly-to-substrate connectors distributed across the flexible backer member as in FIGS. 12A, B and C.

FIG. 13: Ports; exterior views

These ports are useful, for example, in emergency installations where ports provide ventilation and other types of access.

Figure 13A:
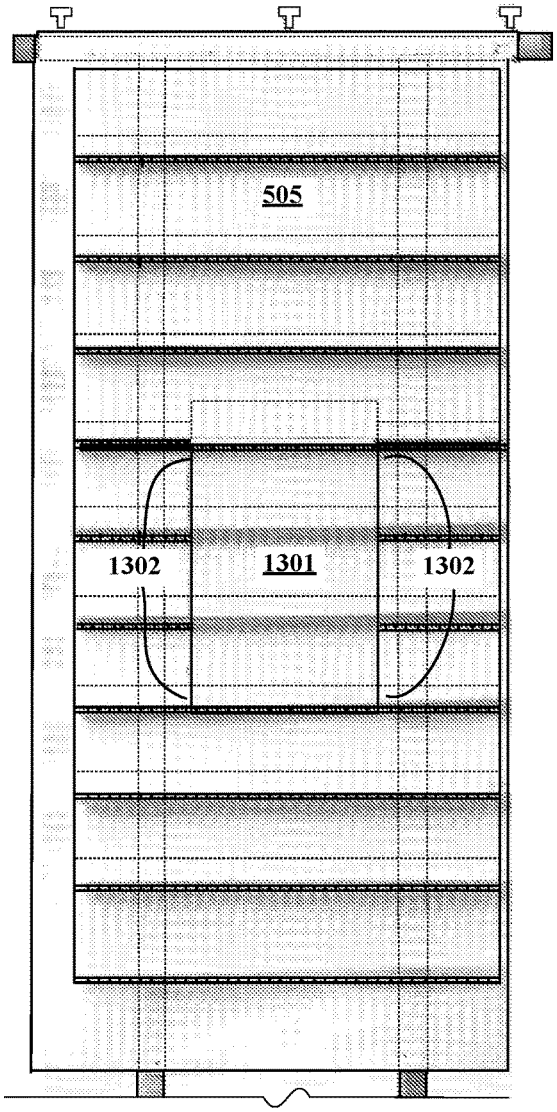

FIGS. 13A and B: A port closed, and open.

FIG. 14: Ports; substrate-side views

Figure 14A:
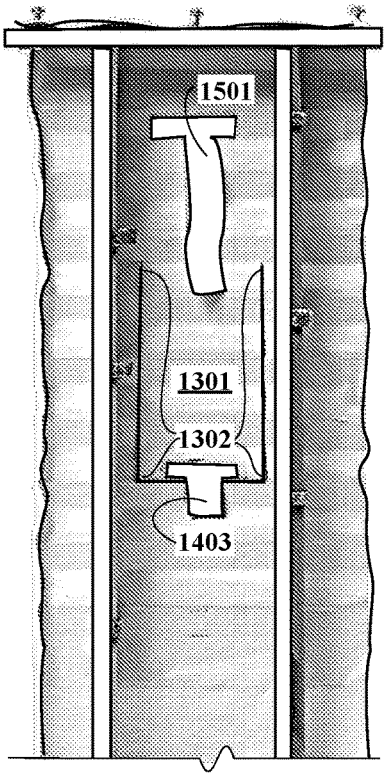

FIGS. 14A, B and C show the substrate side of an assembly with a port which is a cut-away of the main assembly, held down with an added fastener, and up with an added retainer, as well as a close-up, partially opened, of the cut-away port.

Figure 14B:
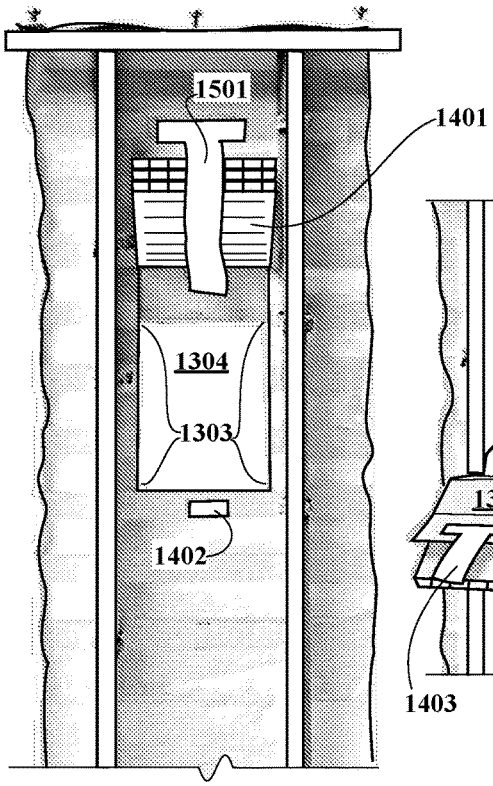
Figure 14C:
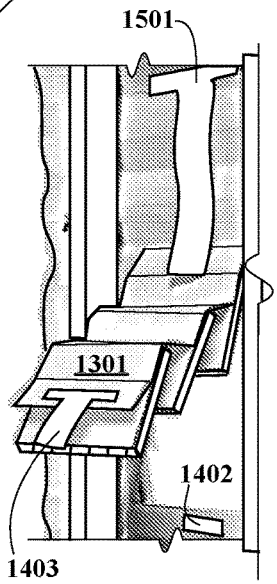
Figure 14D:
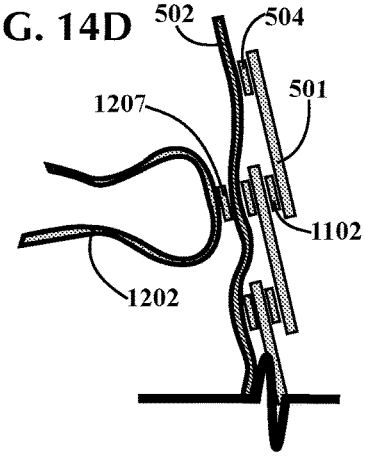

FIG. 14D shows a manner of constructing the assembly which maintains the impermeability of the flexible backer member for prohibiting passage of fluids such as water or gasses from one side of the assembly to the opposite side.

Figure 14E:
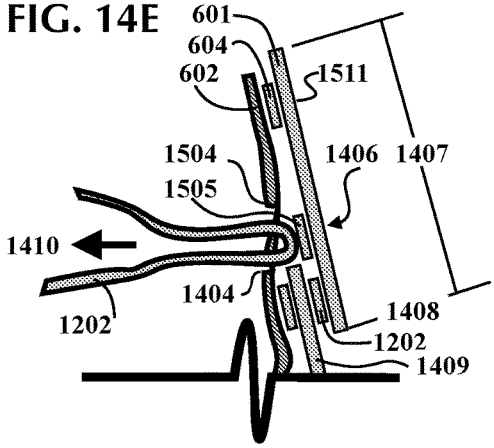

FIG. 14E shows a construction in which the flexible backer member is penetrated, for use in environments where the passage of fluids such as water or gasses is not a consideration.

FIG. 15: Corner boards and moldings

Figure 15A:
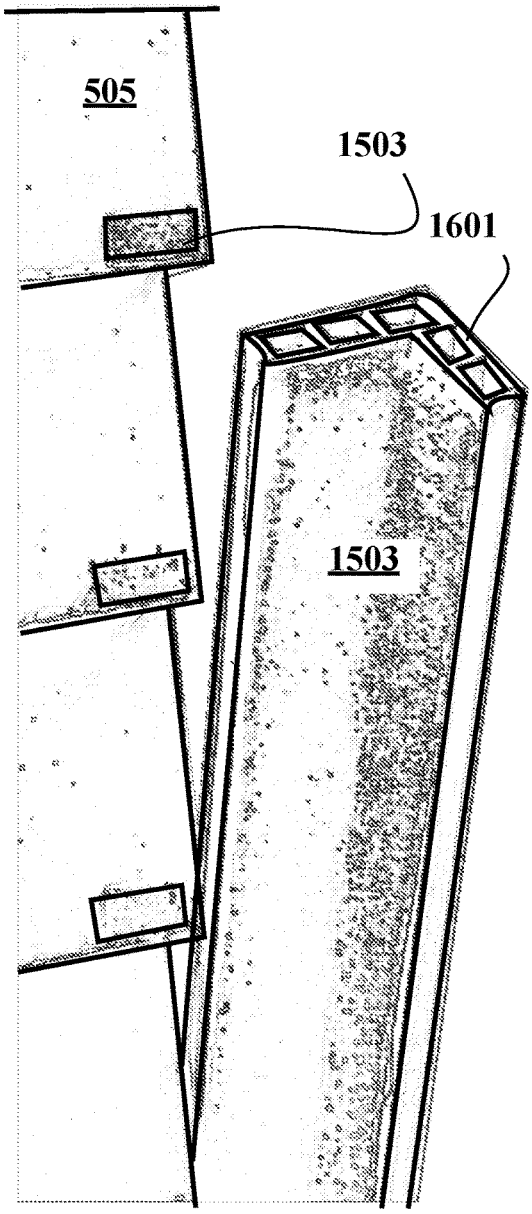

FIG. 15A shows the connector side of the corner molding and the connectors on the assembly side.

Figure 15B:
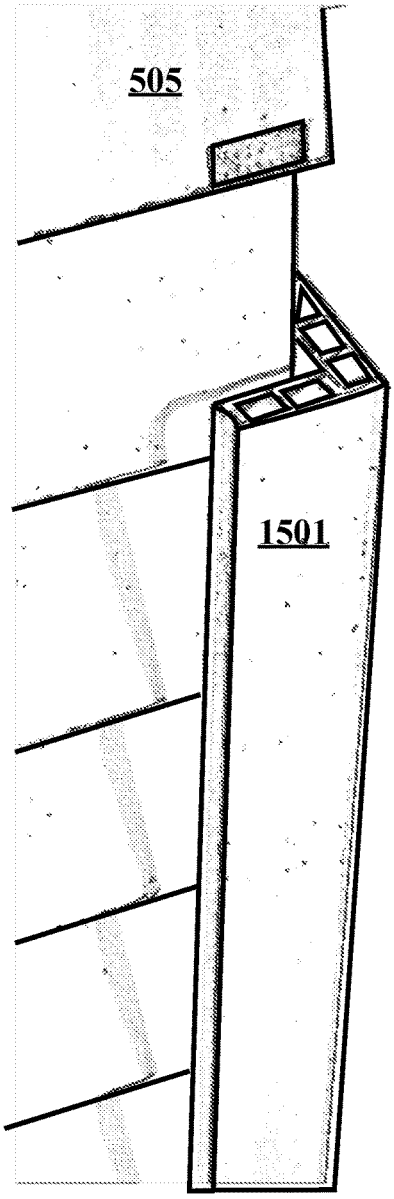

FIG. 15B shows the corner molding on an arrayed assembly.

Figure 16:
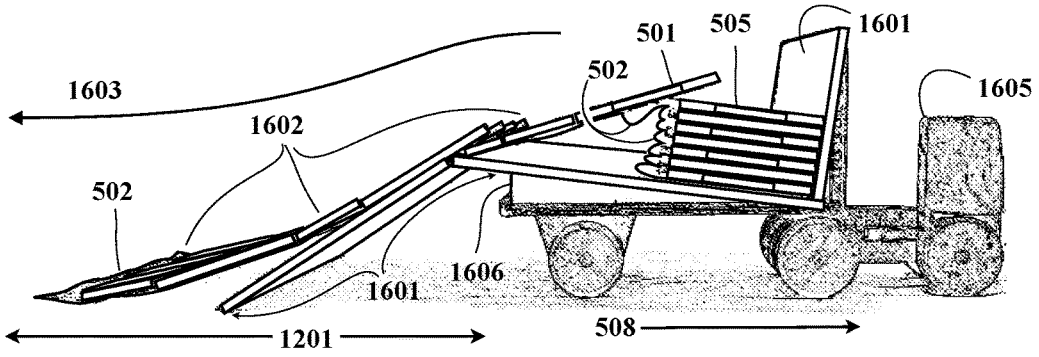

FIG. 16: A vehicle unloading a stacked assembly onto a road from the top of the stack This view shows a vehicle unloading a stack comprised of a horizontally loaded assembly from the top of a stacked assembly onto a road bed.

Figure 17:
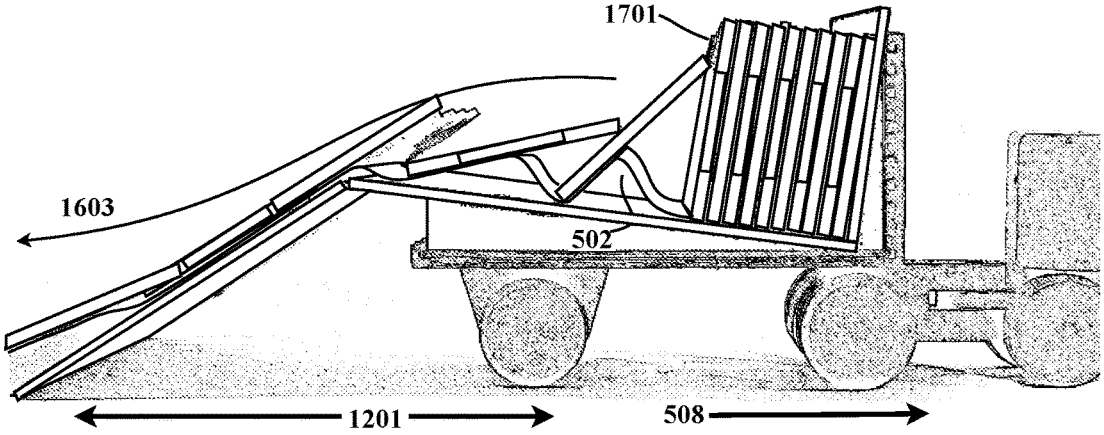

FIG. 17: A vehicle unloading a vertical stacked assembly onto a road

This view shows a vehicle unloading a stack comprised of a vertically loaded assembly onto a road bed.

Figure 18:
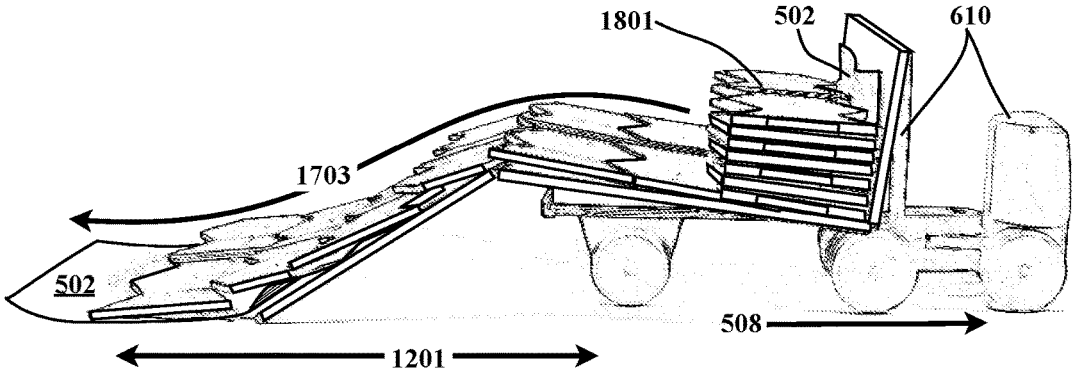

FIG. 18: A vehicle unloading a horizontally stacked assembly onto a road from the bottom of the stack This view shows a vehicle unloading a stack comprised of a horizontally loaded assembly from the bottom of a stack onto a road.

Figure 19:
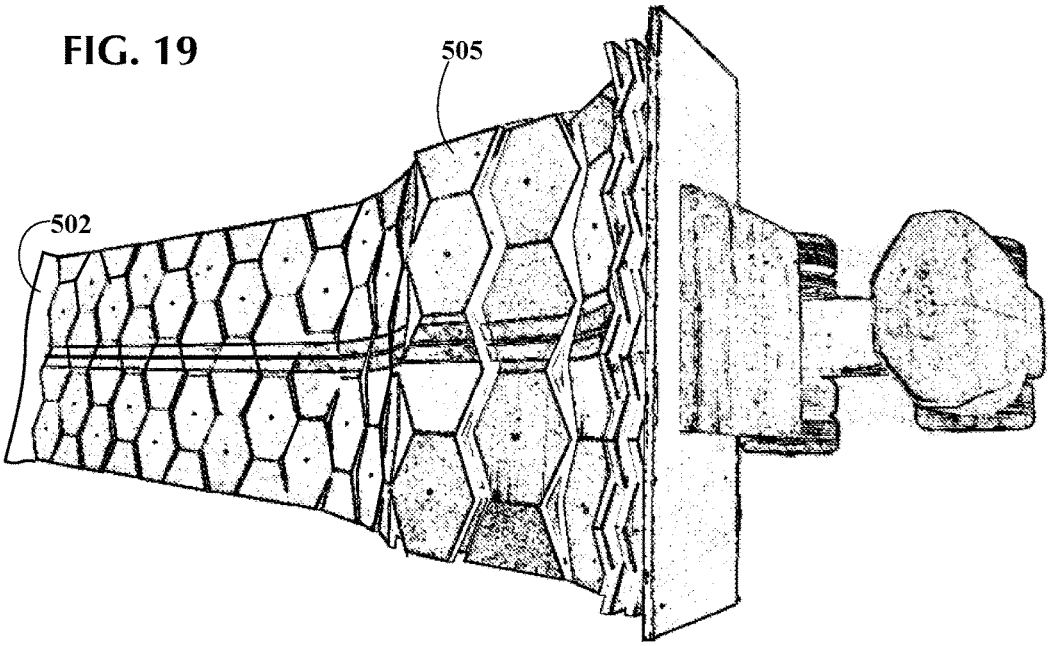

FIG. 19: A vehicle unloading a stacked assembly onto a road viewed from above the vehicle's front This view shows a vehicle unloading a stacked assembly onto a road from the front of the vehicle.

Figure 20:
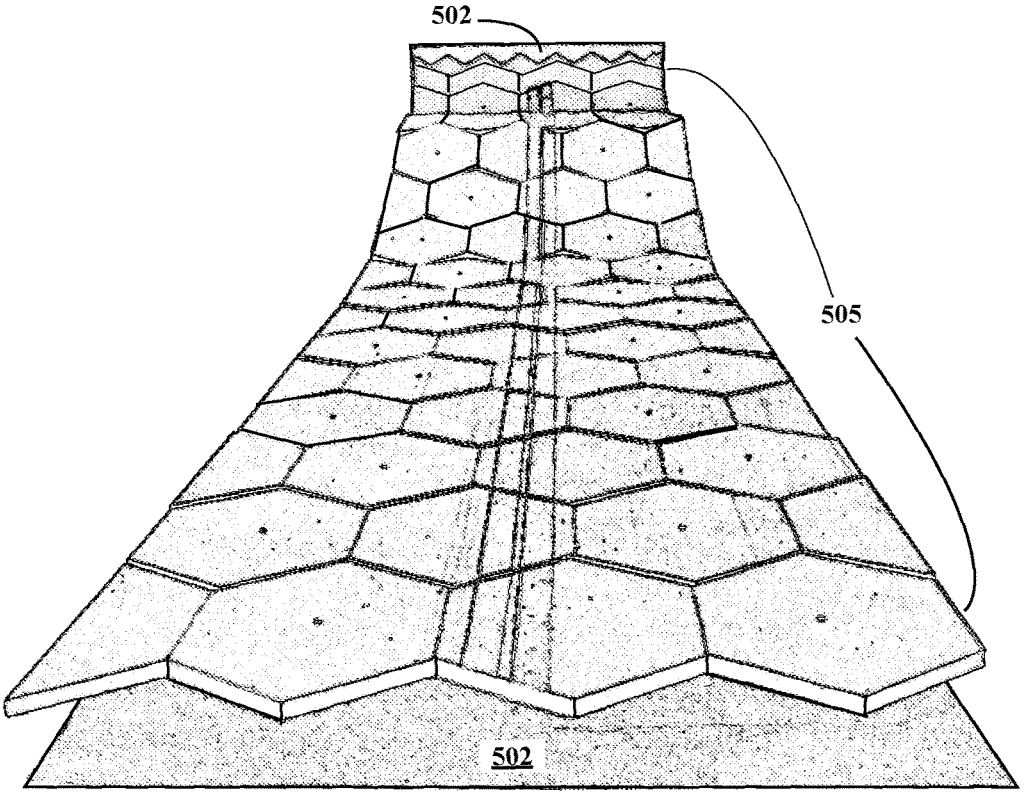

FIG. 20: A vehicle unloading a stacked assembly onto a road viewed from the vehicle's rear.

This view shows a vehicle unloading a stacked assembly onto a road from the rear of the vehicle.

Figures 21A, 21B, 21C, 21D, 21E:
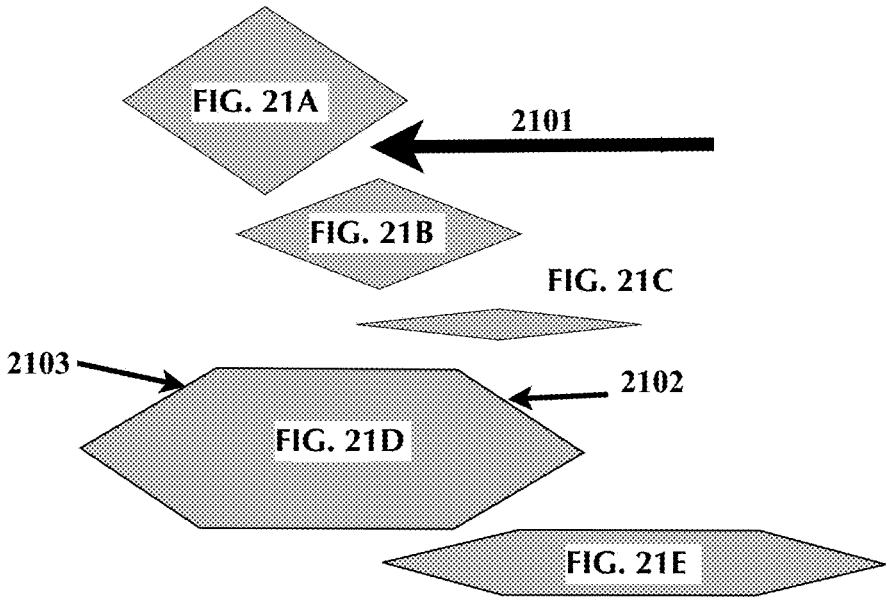

FIG. 21: A series of tile shapes

FIG. 21A-E show examples of tile shapes which achieve reduction in vibration and friction.

Figure 22:
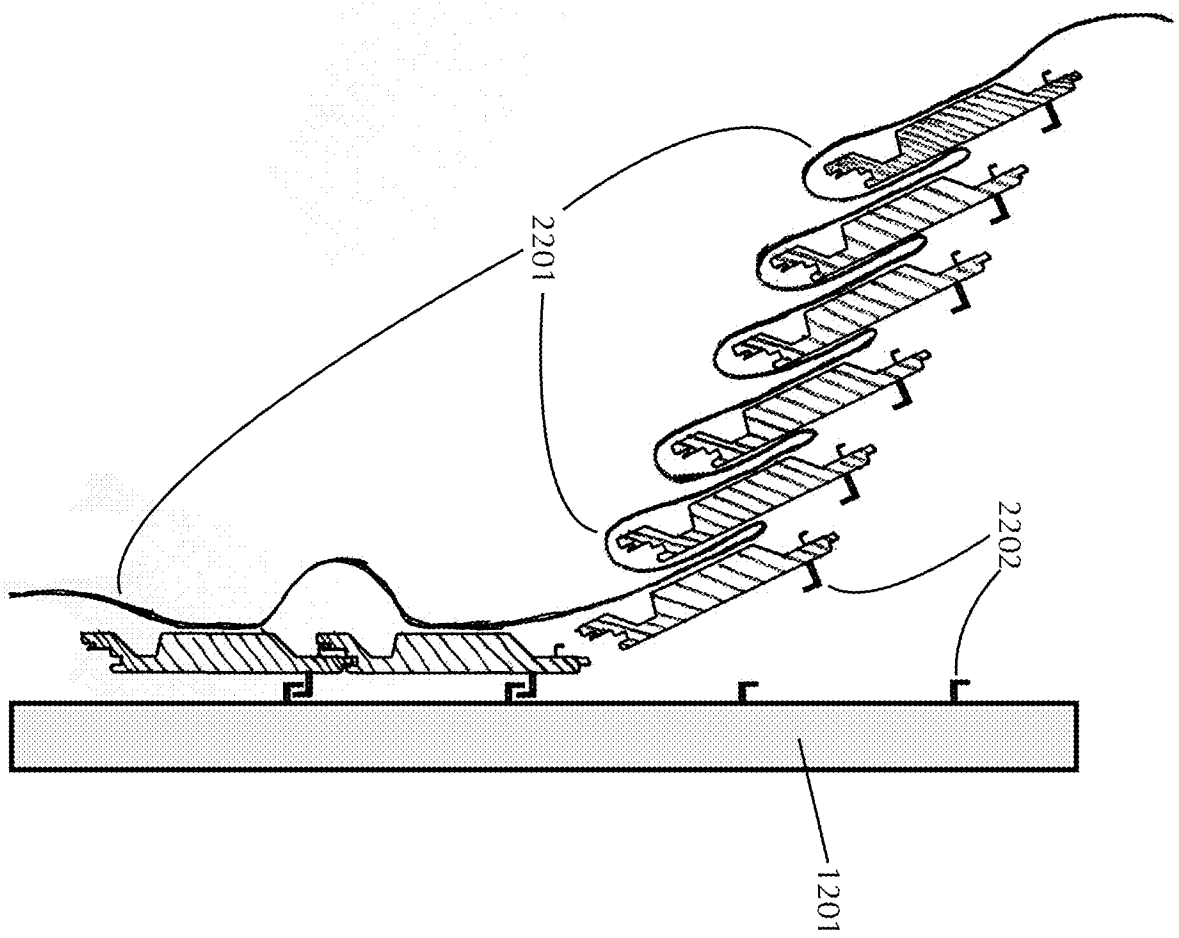

FIG. 22: Assembly with removable flexible backer member

This shows a diagonally loaded assembly being dispensed onto a surface in which the flexible backer member is on the face of the assembly.

FIG. 23: Assembly with self sealing panels

This shows a cascading array of structural insulated panels.

Figure 23A:
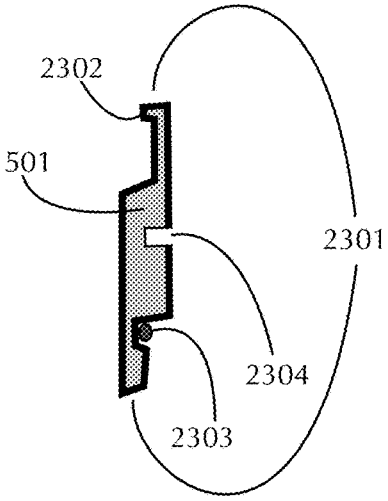

FIG. 23A shows a detail of a panel.

Figure 23B:
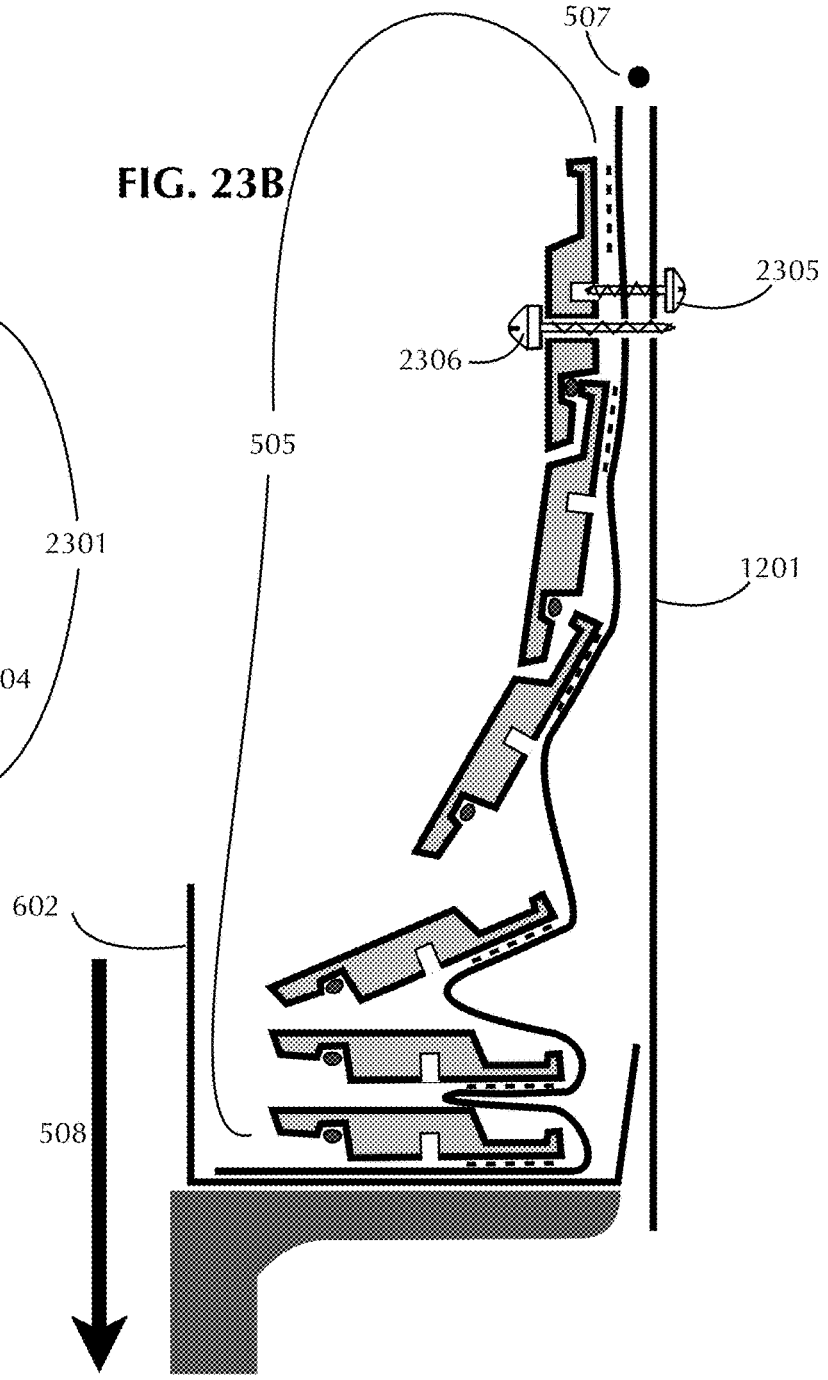

FIG. 23B shows the assembly being dispensed.

FIG. 24: A series of panel to substrate fasteners

FIG. 24A through D, including FIGS. 24A1 through 3, FIGS. 24B1 and 2, FIGS. 24 C1 and 2, and FIG. 24D1 through 5, show various examples of fasteners integrated into panels so that the panel shell remains unpenetrated.

Figure 25:
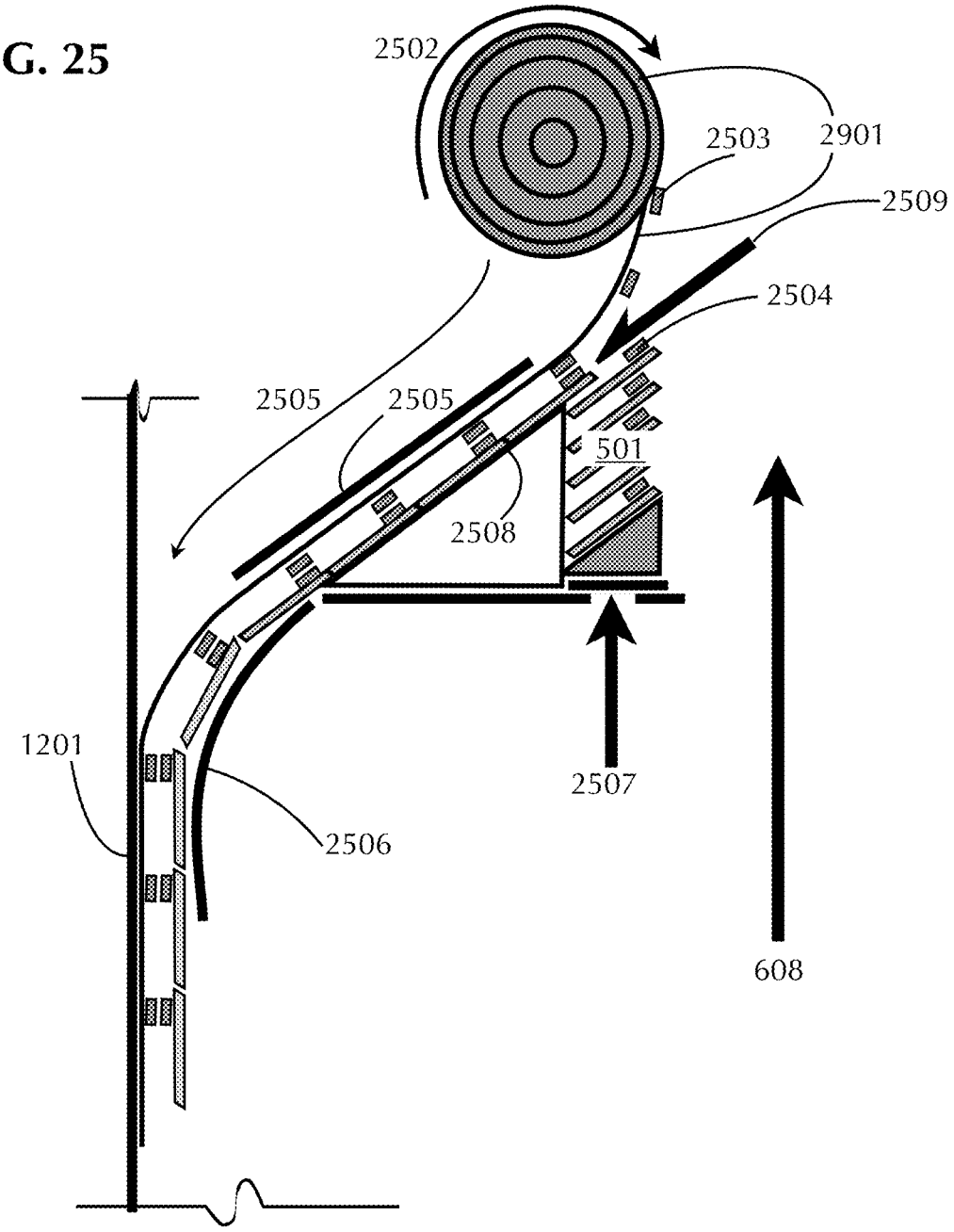

FIG. 25: A rolled flexible backer member with progressively engaging tessellations This drawing shows one embodiment of a system by which a prepackaged flexible backer member, in this instance as a roll, is joined with a prepackaged group of tessellations.

FIG. 26: Three lateral connectors

Figure 26A:
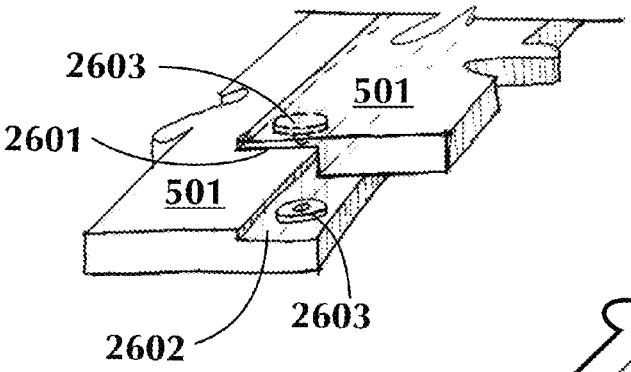

FIGS. 26A, B, and C show a variety of ways which the assemblies can be laterally interconnected.

DETAILED DESCRIPTION OF THE INVENTION

Detailed Description of the Drawings

NOTE: FIGS. 1-4 refer to the prior art.

The preferred embodiment of the invention is illustrated by FIG. 5. FIGS. 5 A-G show a model built of EVA foam tessellations and spunbond olefin fiber, while FIGS. 5 H, J-N, and P-V are schematic drawings illustrating various aspects of the invention.

This figure demonstrates the central elements of the invention.

FIG. 5A shows the separate elements of the assembly ready to be assembled: the tessellations (501), the face of the tessellations which will receive the flexible backer member (501-3); a typical flexible backer member (502); and typical tile-to-flexible backer member connectors (504).

FIG. 5B shows the elements combined into a complete assembly (505) with a flexible backer member (502), and anchor areas (507), being extensions of (502) beyond the assembled tiles.

FIG. 5C shows the completed assembly, stacked.

FIGS. 5D,E and F show how the flexible backer member is restrained in the anchor areas (507), the outer faces of the tessellations (501-4), and a force (508) which progressively draws the assembly from its stacked state.

FIG. 5G shows the array it in its completely opened state. The anchor area (507) may be within, and integrated with, the first tessellation of the assembly to mount on a surface (509).

FIGS. 5H, J, and K refer to the same embodiment, while FIG. 5I refers particularly to a lapped embodiment.

FIG. 5H is a side view showing the elements of the assembly moving into their stacked position, with tessellation (501A) moving in direction A to its stacked position superior to tessellation (501B). Also shown are: the flexible backer member (502); the tile-to-flexible backer member connectors (504); the leading edge of a tessellation (501-1); the trailing edge of a tessellation (501-2); the thickness (b) of the flexible backer member; and the doubled thickness 2(*b*) of the flexible backer member at a fold (c).

FIG. 5I shows a side view of an arrayed, lapped assembly with an overlap (g), the tessellations (501), the flexible backer member (502) including its thickness (b), and the connectors (504).

FIG. 5J is a side view of an assembly in the process of being arrayed on a surface, where (501) are the tessellations, (502) is the flexible backer member attached to the tessellations by the connectors (504). As force (508) is applied to the flexible backer member held in place at anchor point (507), the assembly unfurls onto the substrate (1201), thereby arraying the tessellations in the proscribed orderly arrangement.

FIG. 5K is a side view of a tessellation with measurements for the mathematical description.

(501) is a tessellation.

(502) is the flexible backer member.

(501-1) is the leading edge of the tessellation.

(501-3) is the inside face of the tile.

(501-5) is the outermost point on the trailing edge of the tessellation.

(504) is a connector.

(a) is the leading edge of the connector.

(b) is the thickness of the backer.

(d) is the thickness of the tessellation.

(e) is the total width of the tessellation.

(f) is the distance between the leading edge of the connector and the leading edge of the tessellation.

The preferred relationships between these parameters is discussed below.

FIGS. 5L, 5M, and 5N refer to the same embodiment

FIG. 5L shows a multilevel assembly with tessellations (501); the fold pattern of the flexible backer member (502); and the tile-to-substrate fasteners (504). In this embodiment, the tessellations are not disposed in a single stack.

FIG. 5M shows the arrayed state of the multilevel assembly of FIG. 5L after the flexible backer member (502) is moved by force (508) away from anchor point (507), that is, in the position for mounting the assembly on a substrate (not shown).

FIG. 5N shows the tessellation-(501)-to connector (504) relationship for the multilevel assembly of FIG. 5L. In this embodiment the relationship of parts relative to the leading edge, as shown in 5K, apply to both edges. That is, both edges are considered to be leading edges. Therefore, the drawing denotes two points (a), one for each of the two leading edges (501-1).

FIG. 5P shows four general examples of edge shapes for tessellations (501).

Figure 5Q:
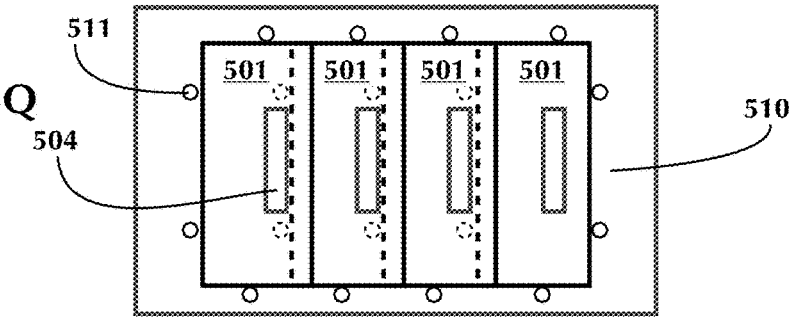
Figure 5R:
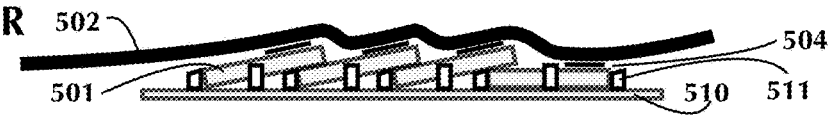

FIGS. 5Q and 5R refer to the same embodiment

FIG. 5Q is a plan view of a layout board (510) set up to create overlapped assemblies with locators (511), tessellations (501) and the attached connectors (504). The setup is shown before being overlaid with the flexible backer member.

FIG. 5R is a side view of the layout board of FIG. 5P with the same elements plus the flexible backer member (502).

FIGS. 5S through V contain the same elements as FIGS. 5P and Q

Figure 5S:
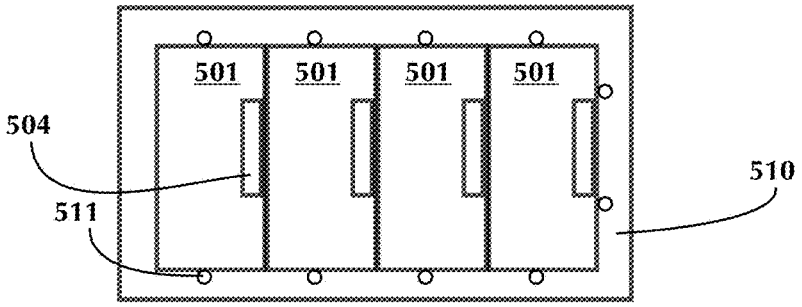
Figure 5T:
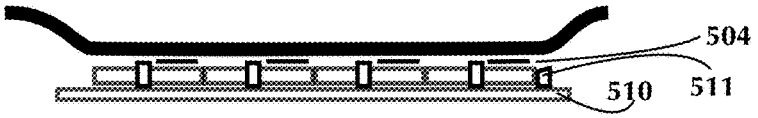

FIGS. 5S and 5T refer to the same embodiment

FIG. 5S shows the plan view of a layout board for a planar, edge-butted tile assembly.

FIG. 5T shows a side view of FIG. 5 S.

Figure 5U:
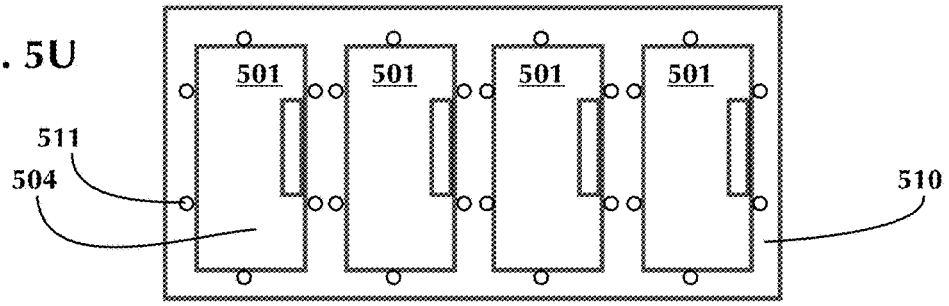
Figure 5V:
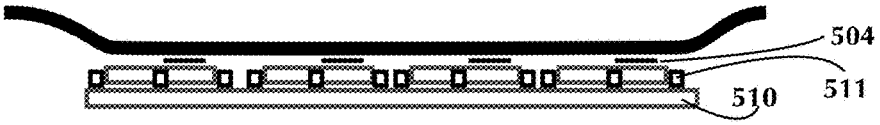

FIGS. 5U and 5V refer to the same embodiment

FIG. 5U shows the plan view of a layout board for a planar tile assembly with spaces between the tessellations.

FIG. 5V shows a side view of FIG. 5 U.

FIGS. 5A through C and H through U describe the method and sequence of manufacture used to produce the prototypes. FIGS. 5A, B, and C are perspectives; FIGS. 5 P, R, and T are plan views before the flexible backer member is included; FIGS. 5H, K, L, M, N, Q, S, and U are side views.

FIG. 5P through U shows three varieties of tessellation arrangements in plan and side views; Overlaps (FIGS. 5P and Q), Butted (FIGS. 5R and S), and Spaced (FIGS. 5 T and U).

The identifiers in (FIGS. 5P and Q) apply as well to (FIG. 5R through U).

In one example of a method for practice of the invention, the principal steps are as follows:

1. The tessellations are cut to size (not shown).
2. Adhesive type connectors (504) are affixed to the tessellations (501) in the calculated locations.
3. (FIG. 5P through U): The tessellations (501) are laid out on a work surface (510); the tessellations may be located in the desired positions by pins (511) defining the location of the tiles in the final assembly.
4. The connectors (504) are secured to the tessellation (501);
5. The flexible backer member (502) is placed over the arrayed tessellations as shown in (FIGS. 5R, T, and V).
6. The flexible backer member (502) is forced against the connectors, creating the assembly.
7. The assembly is removed from the production surface and folded into its stacked state.

FIGS. 5H and K illustrate the attachment of the backer (502) to the tiles (501). In this embodiment a connector (504) is employed. As specified elsewhere, the choice of the connector will be selected responsive to the materials of the backer and tiles. For example, in employment of a spunbond olefin material such as that sold as Tyvek as a backer for wooden clapboards, the connector might be a curable adhesive such as glue or epoxy, or might be double-sided adhesive tape. Where the tiles and backer are metallic, such as steel tiles secured to steel tapes functioning as backers, the connector might be implemented by welding. Thus, it will be appreciated that this terminology is to be construed broadly in different implementations of the invention.

The relative positioning of the connectors with respect to the backer and tiles is important in allowing the tiles to be stacked for shipping, storage and dispensing. This relationship is also illustrated by FIGS. 5 H and K. Thus, to allow stacking, the backer (502) must be adhered with the connector to either/or the underside (501.3) and trailing edges (501.2) of the tiles (501), with the connector adhered, in this embodiment, to the underside of the tiles. More specifically, if the tiles are of width (e) and thickness (d), and the backer and connector are of negligible thickness, the dimension (e-f) of the connector—that is, the distance between the leading edge (501.1) of the tile and the point (a) at which the backer ceases to be secured to the tile by the connector—is equal to e/2−d. Where the backer and connector are of appreciable thickness (b), (e-f) should be set equal to e/2−d−2b to accommodate the fold as at (c). In embodiments requiring variations on the arrangement of the tiles in a stack, the distance (f) can be varied, and the width of the connector (504) can vary. Where the tiles are to be overlapping, as in an installation of clapboards by a distance g, e-f, e/2−d−2b+g.

FIG. 6: Assembly comprised of Z-shaped tiles; opening

This series shows the process of arraying an assembly comprised of Z-shaped tiles and a flexible backer member (502) in a dispenser. As the assembly is dispensed, the Z-shaped tiles interlock with one another (603) forming continuous surface. The end face of the dispenser has been cut away to reveal the tile arrangement in its stacked state.

FIG. 6A shows the folded assembly (601) in a dispenser (602).

Figure 6B:
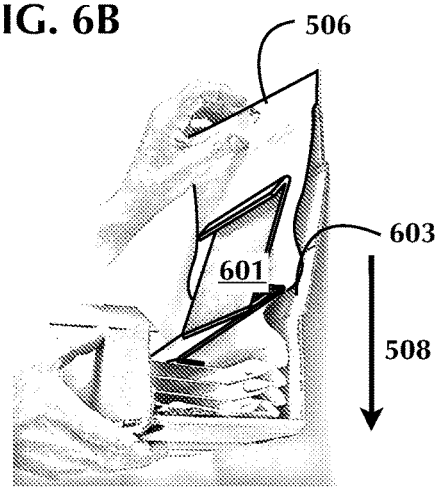

FIG. 6B shows the anchoring of the assembly (506) and the process of moving the dispenser away from the anchor area, causing the assembly to unfold and interlock.

Figure 6C:
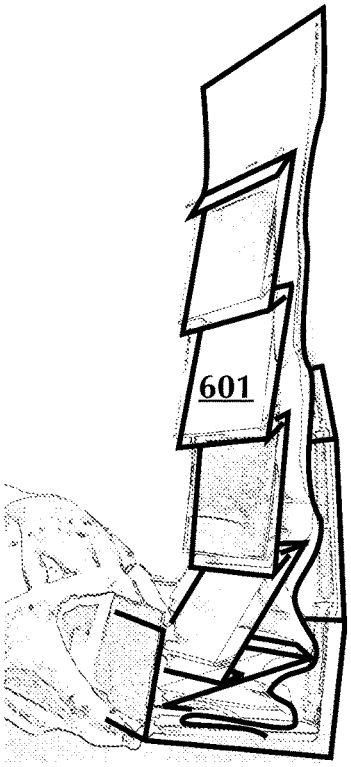

FIG. 6C shows an intermediate stage at which the assembly is leaving the dispenser.

Figure 6D:
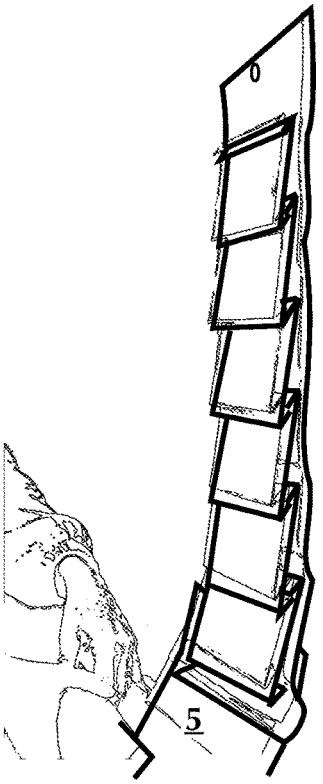

FIG. 6D shows the stage at which the assembly has completed leaving the dispenser.

Figure 6E:
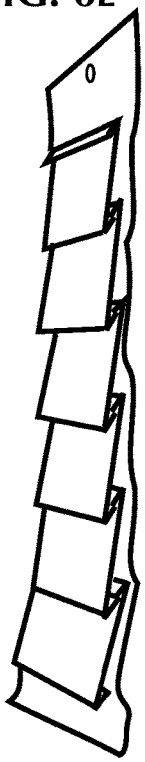
Figure 7A:
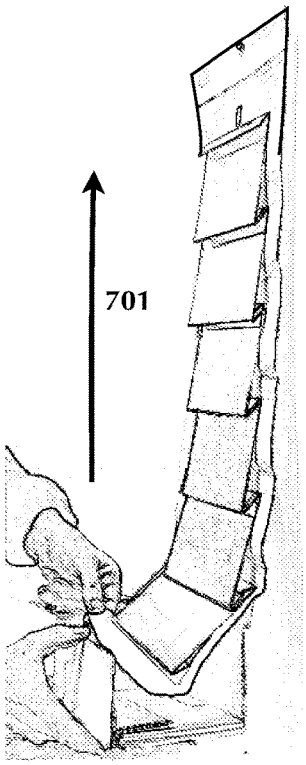
Figure 7B:
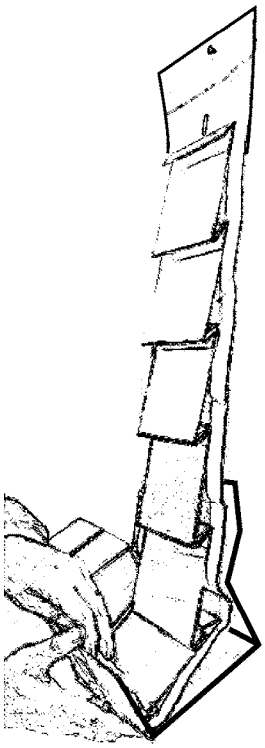
Figure 7C:
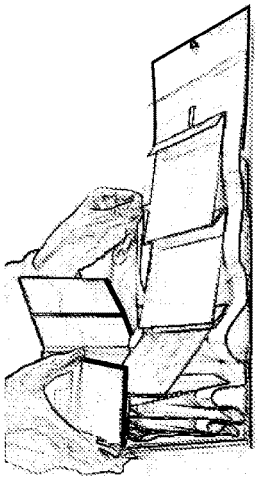
Figure 7D:
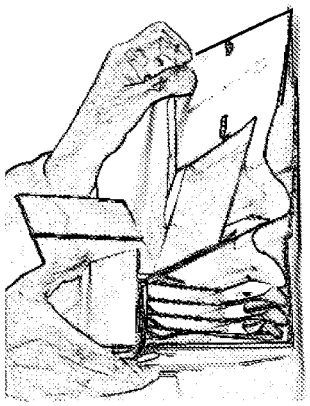
Figure 7E:
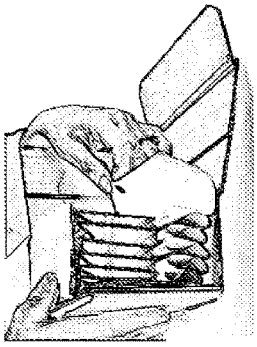
Figure 7F:
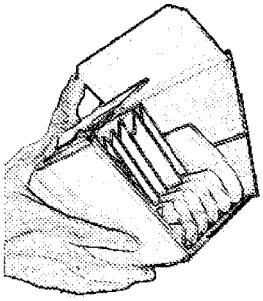
Figure 7G:
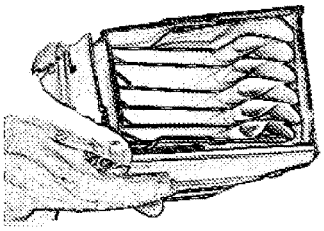

FIG. 6E shows the assembly completely arrayed.

FIG. 7: Assembly comprised of Z-shaped tiles, closing

FIG. 7A through G show the model of FIG. 6 being retracted into a dispenser for future reuse by reversing the process of FIG. 6 while moving in the direction created by the closing force (701).

FIG. 8: Multi-planar assembly

This embodiment, based on the model of FIG. 6 simulates a roof and wall installation. By anchoring the assembly at area (506) and releasing the tile-to-tile connectors at the area of plane change (801), the assembly operates on multiple planes (802, 803), useful for original building and building repairs where parts of a substrate's roof and wall have been damaged.

FIG. 9: Curved assembly

Based on the model of FIG. 6, this shows an assembly curved in a plane for substrates such as vehicles, buildings, and machine parts including a military or construction vehicle tread. Inter-tile connectors may flex (901) while engaged or may disengage as in FIG. 8 (801).

FIG. 10: Z-shaped tile detail

FIG. 10A shows a basic form of one type of interlocking tile.

The tile configurations are applicable to any suitable material and formable by any suitable process, examples being; bending, casting, extrusion and machining. All dimensions (1001 through 1006) and angles (1007,1008) are variable. Returns (1002,1005) of successive tiles can be engaged so to seal to one another or be left loosely engaged to allow for fluid circulation or installation flexibility and curving of the arrayed assembly.

FIG. 10B shows a sampling of possible tile profiles held into a convenient assembly by flexible backer members. In the drawing, on the left side of each group are the tiles (1009), and on the right is the flexible backer member (502).

FIG. 11: Wood clapboards with system connecting tiles to one another at their exterior overlaps FIGS. 11A and B show an entire assembly in its compressed form, where: (502) is the flexible backer member; (501) are the tiles in the form of wood clapboards; (1101) are the packing binders, in this embodiment being double sided hook-and-loop tapes; and (1103) being a lateral support for the assembly.

FIG. 11C shows the unwrapping of the packaged assembly and the unfurling of the flexible backer member (502). On the upper left, note the manual release of the packing binders (1101) which function may also be performed mechanically.

FIG. 11D shows the deployed assembly. The appearance of the array is similar to a manually clapboarded wall with the clapboards precisely located and fastened to one another. (1104) shows a staggered pattern at the lateral interface of the clapboards. This is configured to interface with another similar assembly, thereby covering a wall without the appearance of vertical seams. After deployment, the tiles can be secured to the substrate by any suitable fastener.

FIG. 11E shows a detail of the tile-to-tile connector (1102) which, in this embodiment, is a set of adhesive backed hook and loop connectors. On suitable tile types, other kinds of connectors may be located in this area. When installed, these connectors link each tile to the next tile to manage wind shear or other energies which can disconnect the underlying and overlapping tiles. During installation of this embodiment an option is to provide a smooth membranous barrier between the hooks and loops which temporarily prevents the hooks and loops from engaging until the assembly is properly located, after which the barrier is stripped from the connectors allowing them to engage.

FIG. 12: Ventilating tile assembly

Integrating tiles with various functions confer advantages to the assemblies. The ventilating tiles in this illustration enable cooling, heating or other energy transfer to and from the tiles and the environments on each side of the assembly. Embodiments allow the free passage of circulatory fluid, examples being air, water, or tool cooling fluid which circulate either by natural convection and/or by fans and pumps. Additional embodiments of this type are useful for wind screening, heat dispersion, heat gathering and heat control.

FIG. 12A: In this embodiment incorporating ventilating tiles, the assembly (505), is anchored at (507) to a substrate (1201) exemplified by joists.

FIG. 12B: This shows the substrate side of the assembly where the assembly to substrate fasteners (1202) are either temporarily or permanently attached to the substrate (1201) according to purpose-specific requirements and can be augmented with other fastener systems, for instance by spraying structural foam on an appropriately adherent flexible backer member mounted on the substrate.

FIG. 12C shows the connectors (1202), and the location of the tile-to-tile circulation ports (1203) shown in FIG. 12E.

FIG. 12D shows a diagonal embodiment in which case the substrate is in the position of a roof, with the assembly anchored at the roof crest.

FIG. 12E is a detail view of the outer surface of ventilating tiles showing one possible configuration of edge ventilator ports (1203) for the flow of fluids throughout the tile system.

FIG. 12F shows a detail view of the surface opposite to the side of the tiles shown in FIG. 12E, including one possible configuration of lateral ventilator ports (1204). Other embodiments incorporate multiple ports of various configurations.

FIG. 12G shows yet another embodiment of a ventilating tile. FIG. 12G-a shows the side of a tile nearest the substrate, that surface (1205) being comprised of mesh, perforated sheet, expanded metal and/or similar materials through which circulating fluid flows through the edge ventilator ports (1203). FIG. 12G-b shows the outer face (1206) of a tile, in this embodiment a protective skin.

FIG. 12H shows the substrate side of a flexible backer member (502) with an assembly-to-substrate connector (1202) distributed across the flexible backer member. This particular embodiment is comprised of hook-and-loop tapes mounted so to interface with uniformly spaced substrate members and fastened to the flexible backer member with adhesive tape connectors (1207). The frequency of such connectors is variable, from a great number closely placed like animal fur, to custom placed connectors engineered to specific locations.

FIG. 13: Ports

While arrayed, the assemblies may accommodate openings for ventilation, sight, doors and utilities access and to allow for surfaces to progressively open and close and/or rotate for modulation of various energy forms such as heat, light, x-rays and sound waves. This embodiment of the invention provides for these openings to be created, remain open, be closed and remain closed for optional future use. The following views are of a model exhibiting the principles and functions of the parts which may be of any practical materials.

FIG. 13A shows the port (1301) closed. (1302) are the interfaces where the edges of the port assembly appropriately correspond with the main assembly (505).

Figure 13B:
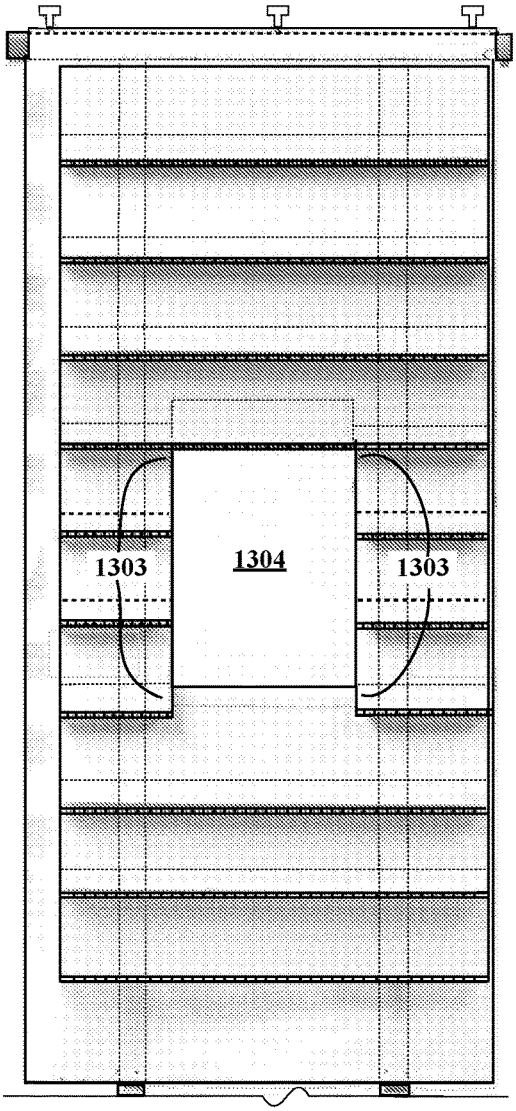

FIG. 13B shows the port (1301) open, including the port edges (1303) which define the port opening (1304).

FIG. 14: Ports, continued

FIG. 14A shows the substrate side of an assembly with the port (1301) closed, the port edges (1302), the port retainer (1401), and the port-to-assembly fastener/port-side element (1403).

FIG. 14B shows the port (1301) folded up, the resultant opening (1304) defined by the opening's edges (1303). Also shown are the port retainer (1401) and the port-to-assembly fastener/assembly-side element (1402).

FIG. 14C shows the port in process of opening, where (1301) is the port, (1401) is the retainer which holds the port in the open position; (1402) is the port-to-assembly fastener/port-side element, in this embodiment a hook-and-loop connector, and (1403) is the port-to-assembly fastener/port-side element.

The port opening (1304) can be further filled with inserts such as permanent or removable windows, screens, doors, ventilators and the like.

The functions of the retainer (1401) and the port-to-assembly fasteners (1402), and (1403) may be fulfilled by cords, pulleys and other means of accomplishing the parts' purpose. Any of these parts may be integrated into the assembly of the present invention or applied with any suitable fasteners including but not limited to hook-and-loop connectors, permanent or temporary mechanical connectors, and adhesive connectors, any of which can be removed if and when necessary.

FIG. 14D: Non-penetrated assembly is a cross section of an assembly such as shown in FIG. 14A-C, above, in which a contiguous substrate envelope is required and where the assembly is comprised of connectors and other elements that attach to the faces of the flexible backer member without penetrating it. In the illustration, (501) is a tile, (502) is a flexible backer member, (504) is a tile-to-flexible backer member connector, (1102) is a tile-to-tile connector, (1207) is a flexible backer member to substrate-tie-in connector, and (1202) is the assembly-to-substrate connector which, in this example, is a string, wire, twist-tie, tape, hook-and-loop tape or the like, which may be combined with any applicable screw, nail or other hardware fastener.

FIG. 14E: Penetrated Assembly is a cross section of an assembly in which the function of the flexible backer member as a contiguous, impermeable barrier is not a consideration.

This embodiment of the assembly is comprised of an assembly-to-substrate connector (1202) attached to a tile (501) through the flexible backer member (502) via an opening defined by the edges (1404) which may optionally be sealed thereby making the flexible backer member impermeable. The assembly-to-substrate connector (1202) connects to a tile with an adhesive or other type binder (1405) at position (1406), being approximately ⅓ the distance from position (1408) relative to a tile of dimension (1407). The connector (1202), bound to the substrate by force (1410), draws the tile at position (1408) in a levering action with (1411) as the fulcrum, toward the proximate tile (1409), making the tile-to-tile connector (1102) optional.

FIG. 15: Corner boards and moldings

This embodiment shows an improvement on standard corner boards and moldings which are generally attached with fasteners such as screws, nails and the like. Because reversibility and quickness of assembly are principles of the present invention, these faciae attach with hook-and-loop or other suitable connectors. Optionally, the corner boards and moldings can be fastened with standard mechanical or adhesive fasteners.

FIG. 15A shows the parts ready for assembly: (505) is the assembly of tiles and backer (not shown); (1401) is the corner board; (1403) are the separate components of a connector system, in this embodiment a hook-and-loop set. The positioning and frequency of the connectors relative to the corner board and the assembly are optional.

FIG. 15B shows the parts (505) and (1401) assembled.

Yet another embodiment (not illustrated) is comprised of corner boards and/or moldings attached to one another with a flexible backer member, the corner boards and/or moldings thereby operating as tiles and the composition thereby forming an assembly of the present invention.

FIG. 16: A vehicle unloading a stacked assembly onto a road from the top of the stack This illustration shows an embodiment for arraying assemblies on a substrate to form a contiguous surface such as a road, including a side view of a transporter (1605) carrying the assembly's tiles (501) and flexible backer member (502), the assembly configured on the transporter so to unload from the top of the magazine or stack (505) in direction (1603). The vehicle is optionally fitted with a set of platens (1601), in this embodiment positioned to support the weight of the assembly, the angles and possible curves of the platens (said curves not illustrated in this figure) calculated so to assist moving the assembly as it unloads from the stack into its arrayed state (1602) on the substrate. One example of a structure providing such an angle is (1606). In this embodiment, the transporter supplies the opening force (508) and the flexible backer member (502) maintains the continuity of the tile sets relative to one another and to the surface onto which the assembly is being arrayed (1604).

For any appropriate embodiments including those pictured herein, additional supports, retainers and conveyors such as conveyor belts, slides, pistons, springs, bearings, spheroids of any material and dimension, rollers and the like (not shown) may be used to facilitate the movement of the assembly from the vehicle to its position on the substrate.

When a stack has entirely moved from its position on the dispenser to the substrate, a new stack is moved onto the dispenser from a hauler vehicle carrying the next stack (not pictured). The new assembly is coordinated or connected to the recently dispensed assembly, and the process continues.

Yet another embodiment comprises a hauler and dispenser combined into one vehicle whereby the vehicle moves away and the next hauler/dispenser aligns with the road to continue the process.

FIG. 17: A vehicle unloading a vertical stacked assembly onto a road

This illustration shows a dispenser unloading an assembly positioned as a vertical stack (1701) in direction (1603) while the vehicle supplies the opening force (508) along a substrate (1201). The flexible backer member (502) can be seen underneath the tiles on the vehicle trailer bed.

FIG. 18: A vehicle unloading a horizontally stacked assembly onto a road from the bottom of the stack As the dispenser Vehicle (510) moves to the viewer's right in direction (508), the horizontally stacked assembly (1801), of which both ends of the flexible backer member (502) are shown, unloads from the stack to the viewer's left in direction (1603), onto the substrate (1201).

FIG. 19: A vehicle unloading a stacked assembly onto a road viewed from above the vehicle's front This view gives a sense of the unloading process and the assembly's position on a road paved by this type of embodiment, showing the assembly (505) and the flexible backer member (502).

FIG. 20: A vehicle unloading a stacked assembly onto a road viewed from the vehicle's rear.

This view gives a sense of the road paved by this type of embodiment, showing the assembly (505) and the flexible backer member (502).

FIG. 21: A series of tile shapes which improve flow over their surfaces

FIG. 21 A through E are examples of tile shapes relating to the flow in direction (2101). Turbulence, vibration and other consequences of such flow, for example tire vibration from the movement of vehicles along a road, air friction on space vehicles during atmospheric reentry, and gas flow in a tubular substrate, benefit from tessellations comprised of forms such as these. The more closely the tiles' leading (2102) and trailing edges (2103) approach the direction of flow (2101), the less the disruption of the flowing elements passing across the tiles' surfaces.

FIG. 22: An assembly with a removable flexible backer member

In this illustration, referring to the assembly (2201), the flexible backer member is attached to the tiles on their front faces, allowing the flexible backer member to perform its alignment function as the substrate-(1201)-to-assembly connectors (2202) are engaged. However, with certain tile types, for instance composite metal tile panel systems with built-in environmental seals, the flexible backer member's insulative function is not essential. Since the flexible backer member may also function as a protective barrier for the outer tile faces during manufacture, shipment and installation, after having served its purpose it may be removed. Alternatively, the flexible backer member itself may be comprised of material suitable to remain attached as a permanent part of the installed assembly.

FIG. 23: An assembly with self sealing structural insulated panels (SIPs)

This illustration show a cascading array of self sealing structural insulated panels. The particular profile and type of panel used is but one example.

FIG. 23A; Cross section 1

In this embodiment, each panel (2301) is comprised of a male sealing element (2302) which, when inserted into the proximate panel's female sealing element (2303), creates a seal isolating the environment on one side of the assembly from the environment on the assembly's opposing side. A rear fastener element (2304) enables the panel to be connected to the substrate without breaching the integrity of the panels' outer skin.

FIG. 23B; Cross section 2

This shows an embodiment of the assembly (505) comprised of self sealing structural insulated panels. The assembly is delivered to the site stacked in any suitable arrangement optionally in a dispenser/container (602). The assembly is anchored in area (507) and moved in the direction and force of arrow (508), causing the assembly to array onto the substrate where the structural insulated panels interlock and seal themselves to one another by the sealer elements. Optional substrate-to tile fasteners (2305-6) enhance the strength of the seal.

While the example implies a vertical substrate, the process is dispensable in any direction.

FIG. 24: Panel to substrate fasteners; four examples

These fasteners may be used with any self sealing structural insulated panels, one example being FIG. 23; Cascading array of self sealing structural insulated panels, item (2305), wherein the self-sealing elements provide the hydraulic and pneumatic impermeability that the flexible backer member serves in other embodiments. However, by binding an assembly to a substrate with fasteners such as those exemplified in this drawing, the sealer elements (2302-3) are activated without compromising the self sealing structural insulated panels' integrity.

FIG. 24A1

This illustration shows a profile view of a panel (501) comprised of a slot (2401) opening on the substrate-side face (2402) of a tile comprised of a penetrable material insert (2403), some examples being high-density polyethylene (HDPE), polystyrene (PS), PET plastic, mixed plastics and wood fiber (often called "composite" lumber), soft metals, "wood-plastic composites" more widely known by different brands like Trex, Azek, Ecornboard etc., and other appropriate materials.

Figure 1:
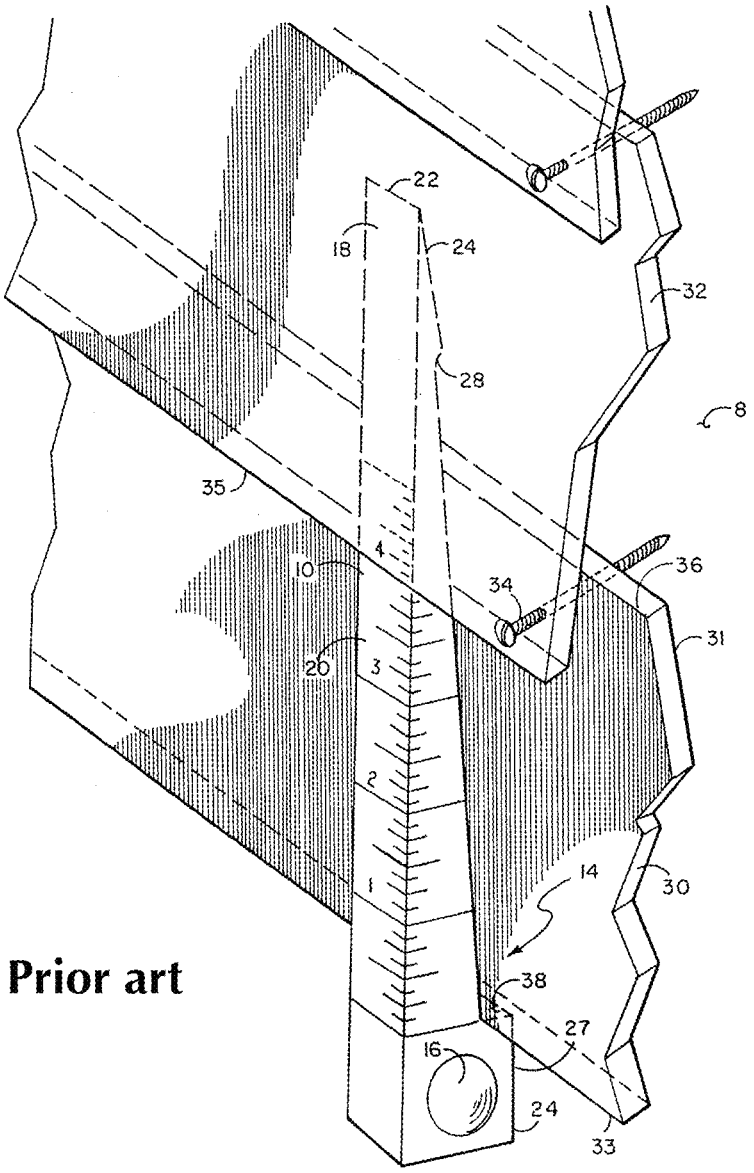
FIG. 1: PRIOR ART; Clapboard slide gauge U.S. Pat. No. 4,879,818 A

This insert provides a ground into which screws, nails and the like can be inserted as a substrate-to tile fastener as in FIG. 24C1 (2305).

FIG. 24A2

This shows the substrate-side face (2402) of the tile of FIG. 24A1 with the insert (2403) being of any useful dimensions.

FIG. 24A3

This shows the substrate-side face (2402) view of a tile wherein the fastening ground is a plug or plugs (2404) which can be of any useful material, shape and/or dimensions.

FIG. 24B1

This shows the profile view of the connector section of a panel similar to FIG. 24A1 with the mounting mechanism being an inset nut (2405) or other fastener such as, wall anchors of various configurations, either fixed or sliding in a track or channel (2406), and further retained by returns (2407) between the track and the outer face of the panel, forming a slot View B2, (2408) into which a second fastener element can pass and engage with the fastener element within the channel. The embodiment may further be comprised of a recess (2409) behind the fastener to accommodate the end of the fastener element that may protrude through the element located in the channel.

FIG. 24B2

This shows the face view of FIG. 24B1 showing the exposed face of the nut (2405) through the slot opening (2408) into the track.

FIG. 24C1

This shows the section view of a panel proximate to a substrate (1201) and a fastener (2305), the function of which is to draw the panel to, and secure the panel to the substrate.

Additionally, this embodiment utilizes the formability of the panel shell (2409) material, one example being aluminum. A fold (2410) is made in the shell on the shell-substrate interface side, which is visible from the substrate side. The fold allows the fastener to enter and anchor in the panel as does a fastener in wood such as a screw or nail, without breaking the continuity of the panel shell which would expose the inner insulating material (2411) to the environment.

FIG. 24C2

This shows the face view of FIG. 24C1 with the face (2402) of the tile.

FIG. 24D1

This embodiment employs a lug (2412), here shown in open position (2413) with a rotating head (2414), also shown in FIG. 24D4, which slides in a channel (2406) in the body of the panel so to easily be moved to a fastener mounting position on a substrate (1201). The lug has a shoulder (2415) which restrains the lug from rotating when extended at roughly 90° to the substrate-side panel face, during the process whereby a nut or other binder is attached to the lug to bind it to the substrate.

FIG. 24D2

This shows the face from the substrate side of the panel showing the lug (2412) end view with the restraining shoulder (2415).

FIG. 24D3

This shows the panel face (2402) from the substrate side along with the lug when it is in its recessed position within the track (2406).

FIG. 24D4

This shows the section view along the panel length with the lug in its recessed position (2412) within the track (2406) and, in dotted lines, having rotated through angle (2416) to the open position as shown in FIG. 24D1.

FIG. 24D5

This shows a variation of the rotating lug head embodiment in which a lug with a hinge (2417) permits the lug shank (2418) to rotate through angle (2416) against the panel face or alternatively into a recess in the tile surface (not shown).

FIG. 25: A rolled flexible backer member with progressively engaging tiles

This illustrates the embodiment of a system by which a prepackaged flexible backer member, in this instance packaged in a roll (2501), is joined with tiles (501) prepackaged in a stack. While the dispenser travels in direction (508), the roll moves in direction (2502) and the tile stack is lifted so to engage the tiles with the flexible backer member in direction (2209), the joined parts proceeding along an inclined plane (2205), creating during the process an assembly of the present invention.

The array is further comprised of flexible backer member-side connectors (2503), and tile-side connectors (2504). The incorporation of a platen (2505) assists the flexible backer member and tiles to securely connect to one another as the assembly, impelled by a force (2509) proceeds along an inclined plane (2508) supported by a convex platen (2506), toward, and adjoining with the awaiting substrate (1201).

The prepackaged flexible backer member may be a stack or other configuration, and the tiles packaged in other configurations according to need. The platens may be incorporated into dispenser containers.

The assembly process described in this section may also be accomplished all or in part within the manufacturing facility.

FIG. 26: Lateral Connectors

Assemblies are laterally connectable to one another by any suitable joining system, the illustration showing two possible interconnection systems:

FIG. 26A shows tiles (501) of an assembly wherein a lap on an edge of a tile (2601) fits into a depression in a proximate tile surface (2602), the matching faces of the overlap containing fasteners, in this example being snaps (2603).

Figure 26B:
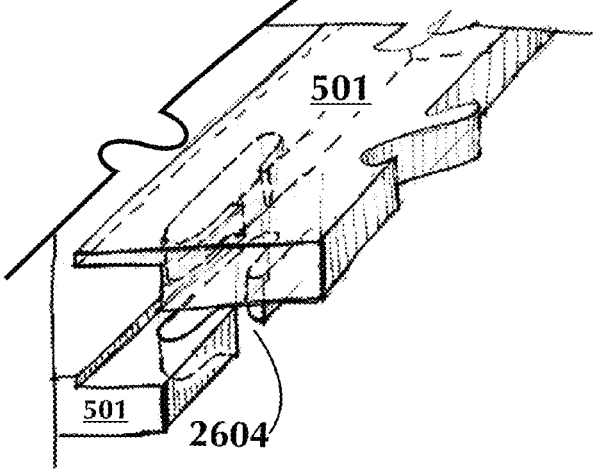

FIG. 26B shows an example, also using lapped tiles (501), of a connector comprised of a tongue system (2604) with male and female parts, the sections of those parts, partially under the illustrated surfaces, shown as dotted lines.

Figure 26C:
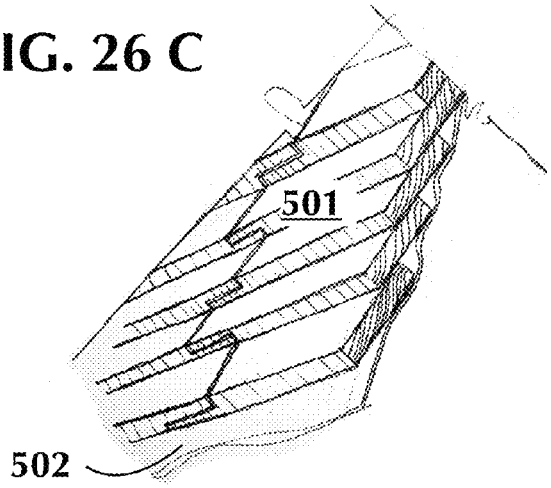

FIG. 26C shows the appearance of the connected lapped tiles (501) along with the flexible backer member (502).

The present invention relates to tessellations attached to a flexible backer member. Whereas the prior art defines these assemblies specifically for grouted ceramic and wood tiling of floors and walls (FIGS. 2,3), assemblies of the present invention improves, recombines and expands these objects of the prior art to a broad range of other applications.

The new assemblies can be prefabricated, folded and/or otherwise consolidated, packaged, transported, arrayed upon and affixed to substrates of any scale, shape or composition. In applications such as siding and roofing of residential homes, embodiments of the present invention harmoniously integrate with elements of the prior art. The unified system of the present invention allows for both manual installation and prefabrication.

It is the combination of the elements of the assembly into the arrangements described in the drawings which define the present invention. Since the embodiments of these arrangements apply to many technologies, the materials employed will vary with the specific application in a manner within the skill of the art.

Applications of the assemblies of the present invention include

- Temporary and permanent buildings;
- Solar panel installations, which benefit by the assemblies' abilities to increase array area and uniformity of appearance while reducing the frequency of potentially leaking joints and damage from ice dams. Damage during installation to existing buildings is reduced by the assemblies' adhesive installation methods which thereby eliminate the percussive effects of hammer-type fasteners;
- terrestrial, waterborne and extraterrestrial vehicles;
- armor for naval, air or space vehicles and constructions such as military camouflage and tank treads;
- protective barriers for vehicles against electromagnetic waves, meteorites and other potentially damaging elements;
- permanent and temporary bridge constructions;
- acoustic damping; energy transduction and modification;
- athletic matting;
- tooling such as abrasive and other finishing belts, wherein the tessellations are comprised of various abrasive materials while optionally allowing free circulation of cooling fluids;
- radial envelopes for constructs such as silos, umbrellas, and water towers;
- beds, including litters, domestic and institutional beds; and medical devices including surgical implants.

The embodiment of the invention to be employed in a given installation will likewise vary according to the use. For instance, a building siding manufacturer might prefer the embodiment illustrated in FIG. 11, a road paving company might prefer the embodiment of FIG. 17, and an emergency substrate manufacturer might prefer the embodiment of FIG. 12.

The embodiment shown in FIG. 5 is a generic model illustrating the principle of the invention and is applicable to many different uses.

General qualities of the assembly elements include:

Assemblies and their elements can be temporary, semi-permanent and/or permanent according to their purpose.

Assembly elements may be: membranous; rigid; flexible; permeable; impermeable; absorbent; fibrous; woven and/or knitted; non-woven; and buoyant.

Assembly elements may be capable of withstanding the effects of energies including: high heat and/or frictional stresses such as those encountered in buildings and vehicles including space vehicles during atmospheric reentry; x-rays; gamma rays; and impacts of projectiles for military armament.

Assembly elements may be removable; examples being for emergency substrates, armor, and the placement of bearings in a race.

The shapes of the assemblies as a whole as well as of the assemblies' individual elements are of any form or combination of forms such as;

concave and/or convex;

regular and irregular polygonal;

ovoid;

microscopic and macroscopic;

helical, domed, curved; and irregular forms to conform to random substrate irregularities such as breached home walls and roofs.

When friction from flow is to be controlled, shapes such as those in FIG. 21 as well as domed and curved tessellations are advantageous. Examples of such embodiments are;

for vehicles on a road whereby vibration is a function of vehicles' tires impacting the edges of road tiles, and;

interaction of vehicles with fluids such as gasses and/or liquids flowing past vehicle exteriors, an example being space vehicles during atmospheric reentry.

The assemblies' flexibility may vary widely according to use. For instance, embodiments of the assembly may be engineered to conform to any designed or chaotic surface; to absorb shocks from environmental, mechanical and other systemic events such as rapidly rising air pressure within buildings generated by high wind velocities; and earthquakes.

Strength of the arrayed assemblies is increased in some embodiments by absorbent or adherent flexible backer members of the present invention being sprayed and/or otherwise impregnated with a consolidator, examples being:

pitch;

synthetic resins such as epoxy and polyester; and flowable setting mineral agglomerates such as plaster and cement.

By employing this system, the consolidated assembly efficiently replaces traditional building envelopes comprised of separately applied elements such as backing boards, spunbond olefin fibers such as Tyvek®, and tiles such as clapboards and/or shingles.

The following list of materials for the tiles and backers is included in this specification not to limit the uses of the present invention, but to give a sense of breadth concerning its possible applications. Materials which may be used include but are not limited to the following:

contiguous sheeting and films such as, but not exclusively; polymers including polymer foams; thermoplastics; graphene; BoPET (Biaxially-oriented polyethylene terephthalate) one example being Mylar®; solar road tiles; straps; belts; and/or bands;

woven and knitted materials such as but not exclusively: cotton; wool; polyester; carbon fiber; fiberglass; and bias-cut fabrics.

non-woven fabrics such as, but not exclusively; spunbond olefin fiber;

fibrous elements including but not exclusively; wires, threads, cords, ropes, and monofilaments;

a plurality of filaments similar to fur on an animal pelt;

various energy forms, one example being magnetism;

synthetic rubbers and/or synthetic polymers such as but not exclusively; EPDM, neoprene, nitrile, silicone, sponge rubbers, and polyisoprene;

organic materials such as rubber, latex and its derivatives, and modified bitumen;

composites including resin-impregnated fabrics such as those used for abrasive grounds;

metals;

glass; including but not exclusively: transparent, translucent and light-responsive materials;

optical polymers, examples being: polycarbonate and various light responsive eyeglass-lens-type materials;

photovoltaic or other energy transducers such as: solar panels and reflectors;

electrical components and connectors for the transmission of energy and data;

composite structural insulated metal panels including self sealing panels;

links, chains and/or cables;

meshes;

tubular elements, examples being: telescopes; microscopes; drainage and oil well pipes;

corrugations including but not exclusively; plastic sheets comprised of ventilating elements;

blocks; slabs; flakes; scales; plates; recycled trash;

ceramics and wood other than those of the prior art;

concrete; asphalt; and/or abrasives.

Assemblies may have lubricant and cushioning qualities, allowing the assemblies to be dispensed with minimal friction and percussion between the assemblies' proximate folded elements. The lubricant qualities may be enhanced by the integration of materials possessing inherently low coefficients of friction such as, but not exclusively:

carbon fiber;

fiberglass;

polyester fiber compositions and/or;

glass beads or other spheroids;

rollers;

petroleum;

silicone;

polymerizing tetrafluoroethylene (PTFE);

graphite, and talc.

A wide range of connectors used to secure the tiles to the backer, and fasteners used to secure the tiles to a substrate include but are not limited to the following:

Penetrators such as nails, screws and staples;

Adhesives such as glues and tapes;

Energies such as magnets and other energy forms;

Filaments such as wires, ropes, electronic cable ties threads, and cords;

Links such as chains in any scale and material;

Hook and loop elements which cover the entire flexible backer member surface not only operate as fasteners, but when consolidated, also function as structural elements.

Opposing elements of the hook-and-loop system may also be attached to convenient substrate elements which will come in contact with the opposing hook-and-loop elements attached to the assembly. As the assembly comprised of the hook and loop element is arrayed, it is pressed against the opposing hook-and-loop element, securing it to the substrate. A temporary separator may be located between the hook and loop faces, to be removed after the assembly is accurately placed. This embodiment is also useful for attaching the assemblies to existing substrates where the substrate side of the applied assemblies are inaccessible from the substrate's juxtaposed, or inner side;

Additional types of connectors and fasteners include:

In yet another embodiment of a connector, the flexible backer member is, on the substrate side, comprised with a plurality of filaments similar to fur on an animal pelt, permitting the filaments to be bound to any available substrates. This mass can be gathered, combed and otherwise organized, then sprayed and/or otherwise impregnated with a consolidator. The resulting combination efficiently replaces the entire traditional assembly of clapboards and shingles, spunbond olefin fiber such as Tyvek®, and backing board. An advantage of this embodiment is that the plurality of filaments, being thickly massed, also function as an insulator.

In another embodiment, connectors also function as spacers at the lateral edges of proximate tessellations. These maintain specific spacing between said tessellations and optionally interconnect the tiles for control of expansion/contraction forces, and drainage and for the transmission of energies such as digital data.

Yet another embodiment for fastening elements of the assemblies to substrates is by manual and/or machine sewing (not illustrated).

Penetrability of the Flexible Backer Member

In embodiments where a highly stable, contiguous envelope is required, the new invention can be assembled without any penetration of the flexible backer member and by assembly of proximate assemblies with substantial, secure flexible backer member overlaps (FIG. 14, View D).

In embodiments where the flexible backer member's penetrability is not an issue, fasteners are fastened directly to the tiles, passing through the flexible backer member and attaching to the substrates. The flexible backer member can be of separate elements or a contiguous sheet pre-perforated in any pattern to facilitate insertion of the connectors (FIG. 14, View E).

With substrates of the prior art incorporating backing boards, i.e., for buildings, standard mechanical connectors such as screws and nails may connect the assemblies to substrates from the assembly's outer face.

Since tessellations are located and held in place relative to one another by the flexible backer member, filling the interstices between the tessellations is optional. In some instances the absence of such fillers is an advantage: In embodiments deployed, for instance, on roads, the openings between the tessellations allow for drainage within the roadway surface and expansion and contraction of the tessellations, reducing road degradation and extending the working life of the road.

Assemblies can be arrayed in any direction and combination and are compatible with traditional installation methods and installations thereby allowing assemblies to be added to and maintained with materials and techniques of the prior art.

Contiguous arrays are moved into place, interlocked and connected to substrates. Emergency dispensation is improved by quick fasteners such as those illustrated in (FIG. 12, #1202; FIG. 14, D&E; 1202). For roof installations, assemblies may be attached to substrates with non-percussive connectors such as adhesives, thereby reducing damage and dirt inside attics and other areas beneath said roofs resulting from the prior art's construction process.

Yet another embodiment comprises prefabricated and pre-spaced mounting elements on a band, tape, strap, strip or other conveyance. The spacing of such fasteners is coordinated during engineering and fabrication with the assembly. In sequence, the fastener group is mounted, positioned and fastened to the substrate. Thereafter, the assembly is arrayed on the surface in its correct position.

Detailing of windows, chimneys, ventilators, corners, eaves and other surface variations may be achieved by techniques of the prior art, thereby integrating seamlessly with the present invention, the end product being a totally integrated surface. With prefabricated assemblies the openings and other details may be engineered and precut, further reducing detailing costs.

Combining the elements making up the assembly of the invention can be performed manually by assembling the elements piece by piece, or by industrially manufacturing the assemblies by more efficient methods, for example by incorporating CAD-CAM, robotics and other high-volume processes.

Yet another embodiment comprises a kit (not illustrated) for emergency installations and other situations comprised of tools and materials such as but not exclusively: cutters; fasteners; edge binders; open position retainers (1401); port-to-assembly fastener/port-side elements (1402); and port-to-assembly fastener/assembly-side elements (1403).

What is claimed is:

1. A method for assembling a number of substantially uniform tiles to a substrate comprising the steps of:

preparing a number of said tiles, each said tile having an outside surface and an inside surface intended to be disposed adjacent a surface of said substrate;

providing a flexible backer member having opposing outside and inside surfaces;

securing all of the inside surfaces of the tiles to the outside surface of the backer member at predetermined intervals, wherein the inside surface of the backer member is free of the tiles or securing all of the outside surfaces of the tiles to the inside surface of the backer member at predetermined intervals, wherein the outside surface of the backer member is free of the tiles;

stacking the tiles one atop the next, with the backer member being folded between adjoining tiles, and with faces of each of the tiles oriented in the same direction, juxtaposing a stack of the tiles and the backer member to the substrate to which the tiles are to be assembled;

applying tension to the folded backer member, so as to successively remove individual ones of said tiles from the stack of the tiles, and so as to juxtapose the tiles to the substrate at predetermined intervals; and securing the tiles to the substrate to form a single layer of tiles.

2. The method of claim 1, wherein the uniform intervals at which the tiles are secured to the backer are such that when assembled to the substrates, the tiles are aligned.

3. The method of claim 1, wherein the uniform intervals at which the tiles are secured to the backer are such that, when assembled to the substrate, the edges of adjoining tiles are partially overlapped within the thicknesses of the proximate tiles.

4. The method of claim 1, wherein the uniform intervals at which the tiles are secured to the backer are such that when assembled to the substrate, the edges of adjoining tiles are in a plane.

5. The method of claim 1, wherein the backer is attached to the inside surfaces of the tiles and forms a part of the assembly of the tiles to the substrate.

6. The method of claim 1, wherein the backer is attached to the outside surfaces of the tiles and is removed from the tiles after assembly of the tiles to the substrate.

7. The method of claim 1, wherein the tiles extend transversely of the backer.

8. The method of claim 7, wherein said tiles are elongated and opposed edges of the tiles are formed cooperatively such when the tiles are assembled to the substrate, their adjoining edges are secured to one another.

9. The method of claim 1, wherein said substrate lies in a flat plane.

10. The method of claim 1, wherein said substrate defines a curved surface.

11. The method of claim 1, wherein adjoining ones of said tiles have mating transverse edges of corresponding non-linear shape.

12. The method of claim 1, wherein said tiles are formed of buoyant material.

13. The method of claim 1, wherein said tiles are selected from the group comprising: clapboards; shingles; links; chains; cables; solar road tiles; insulated metal panels including self-sealing panels; photovoltaic or other energy transducers; electrical components; meshes; and corrugated sheet material.

14. The method of claim 1, wherein said tiles are formed of material selected from the group comprising: fiberglass; cement; polymers; polymer foams; thermoplastics; non-woven fabrics; organic rubber, latex and its derivatives; modified bitumen; composites including resin-impregnated fabrics; plastic films; metals; glass; substrates to which are secured filaments; ceramics; and wood.

15. The method of claim 1 wherein said tiles are secured to the substrate by mechanical connectors.

16. The method of claim 1 wherein said tiles are secured to the substrate by welding and soldering.

17. The method of claim 1 wherein said tiles are secured to the substrate by a consolidant selected from the group comprising: curable resins; pitch; epoxy; polyester; flowable setting mineral agglomerates; plaster; and cement.

18. The method of claim 1 further comprising the step of applying a lubricant to said tiles to reduce friction between the tiles during the unfolding process.

19. The method of claim 17, wherein said lubricant is selected from the group comprising: carbon fiber, fiberglass and polyester fiber compositions; glass beads; polymer spheroids; liquid, powder and solid lubricant films.

20. The method of claim 1 further comprising the step of applying members of cushioning material to the tiles, reducing abrasive and impact damage during the unfolding process.

21. The method of claim 1 further comprising the step of incorporating pre-positioned sealing elements into the manufactured tile assembly.

22. The method of claim 1, wherein the tiles are secured to the backer by a connector, the tiles are intended to be assembled to the substrate in a planar relationship, that is, side-by-side with the proximate edges butted, and wherein the connector secures the backer to each tile over a portion of the surface of the tile to a dimension e−f, where e−f=e/2−d−2b, in which e is the width of the tile, d the thickness of the tile, and b the thickness of the backer.

23. The method of claim 1, wherein the tiles are secured to the backer by a connector, the tiles are intended to be assembled to the substrate in a planar relationship, that is, side-by-side with gaps between the proximate edges, and wherein the connector secures the backer to each tile over a portion of the surface of the tile to a dimension e−f, where e−f=e/2−d−2b, in which e is the width of the tile, d the thickness of the tile, and b the thickness of the backer.

24. The method of claim 1, wherein the tiles are secured to the backer by a connector, the tiles are intended to be assembled to the substrate in overlapping relationship, and wherein the connector secures the backer to each tile over a portion of the surface of the tile to a dimension e−f, where e−f=e/2−d−2b, in which e is the width of the tile, d the thickness of the tile, b the thickness of the backer and connector.

25. The method of claim 1, wherein the uniform intervals at which the tiles are secured to the backer are such that the tile face profiles of adjoining tiles partially overlap, said tile face profiles including at least one member of a group consisting of: rectangles, triangles, diamonds, and curves.

* * * * *